US007771039B2

(12) United States Patent
Sakagami

(10) Patent No.: US 7,771,039 B2
(45) Date of Patent: Aug. 10, 2010

(54) INK JET PRINTER

(75) Inventor: Yusuke Sakagami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 224 days.

(21) Appl. No.: 11/873,552

(22) Filed: Oct. 17, 2007

(65) Prior Publication Data

US 2008/0094459 A1 Apr. 24, 2008

(30) Foreign Application Priority Data

Oct. 20, 2006 (JP) ..... 2006-286036
Oct. 1, 2007 (JP) ..... 2007-257183

(51) Int. Cl.
*B41J 2/01* (2006.01)
*B41J 29/38* (2006.01)

(52) U.S. Cl. ..... 347/102; 347/17; 347/104

(58) Field of Classification Search ..... 347/17, 347/101, 102, 104
See application file for complete search history.

(56) References Cited

U.S. PATENT DOCUMENTS

2002/0067403 A1* 6/2002 Smith ..... 347/104

FOREIGN PATENT DOCUMENTS

| | | | |
|---|---|---|---|
| JP | 10-151733 | | 6/1998 |
| JP | 10151733 A | * | 6/1998 |
| JP | 10/229688 | | 8/1998 |
| JP | 2000-177907 | | 6/2000 |
| JP | 2005-178251 | | 7/2005 |
| JP | 2005-178252 | | 7/2005 |

* cited by examiner

*Primary Examiner*—Matthew Luu
*Assistant Examiner*—Jannelle M Lebron
(74) *Attorney, Agent, or Firm*—Workman Nydegger

(57) ABSTRACT

An ink jet printer that performs printing by discharging ink droplets from nozzles of an ink jet head onto a print medium includes: a moisture adjusting unit that is provided at a downstream side of the ink jet head in a print medium transport direction and adjusts moisture of the print medium by moving moisture of a printing surface of the print medium, onto which the ink droplets are discharged from the ink jet head, to a surface opposite the printing surface; and a moisture adjustment control unit that controls moisture adjustment of the print medium performed by the moisture adjusting unit in accordance with a ratio of the number of nozzles, from which the ink droplets from the ink jet head are discharged, to the total number of nozzles.

6 Claims, 16 Drawing Sheets

INK JET PRINTER

BACKGROUND

1. Technical Field

The present invention relates to an ink jet printer that prints a predetermined character, an image, and the like by discharging fine particles (ink droplets) from a plurality of nozzles so as to form ink dots on a print medium.

2. Related Art

In general, such ink jet printers are not expensive and allow a high-quality color printed matter to be easily obtained. Accordingly, such ink jet printers have been widely spread into not only offices but also general users with the widespread use of personal computers, digital cameras, and the like.

In such ink jet printers, it is general that ink droplets are discharged from nozzles of an ink jet head while a movable body called a carriage, in which an ink cartridge and an ink jet head are integrally provided, is reciprocating on a print medium in a direction crossing a transport direction of the print medium so as to form fine ink dots on the print medium, thereby creating a predetermined printed matter. By providing the carriage with ink cartridges corresponding to four colors (black, yellow, magenta, and cyan) and ink jet heads for the four respective colors, not only monochrome printing but also full color printing can be easily performed.

In addition, in an ink jet printer in which a carriage is not used but a long print head having the same size as the width of a print medium is provided, it is not necessary to move the print head in the width direction of the print medium and so-called one pass printing is possible. Accordingly, high-speed printing becomes possible similar to an electrophotographic printer. In addition, an ink jet printer corresponding to the former method is generally called a 'multi-pass type ink jet printer', and an ink jet printer corresponding to the latter method is generally called a 'line head type ink jet printer'.

Here, in the case when water-based ink is used in an ink jet printer, curving of a print medium after printing, so-called curl is a problem. In order to prevent such curl from occurring, a technique in which curl prevention liquid is coated on a surface of a print medium opposite a printing surface immediately after printing and then the print medium is caused to pass through a heat roll heater having heat sources disposed up and down so as to dry the print medium is used in an ink jet printer disclosed in JP-A-10-151733, for example. In addition, in an ink jet printer disclosed in JP-A-2005-178251, curl is prevented by providing a vapor generator, which uses heating or ultrasonic vibration, inside a roller serving to transport a print medium and applying vapor from a surface of the roller onto a surface of a print medium opposite a printing surface. In addition, in an ink jet printer disclosed in JP-A-2005-178252, a technique of detecting the humidity of a printing environment and controlling the amount of vapor generated in accordance with the environmental humidity is disclosed in addition to the ink jet printer disclosed in JP-A-2005-178251.

However, in the ink jet printers disclosed in JP-A-10-151733, JP-A-2005-178251, and JP-A-2005-178252, it takes time to dry a print medium and consumption of energy required for heating is large since curl prevention liquid or vapor is also applied on a print medium in addition to ink required for printing. In addition, even though there may be a print medium with no curl depending on a printing state, waste of energy is large in a point that curl prevention liquid or vapor is applied on all print media and the print media is dried.

SUMMARY

An advantage of some aspects of the invention is that it provides an ink jet printer capable of preventing curl of a print medium while suppressing the amount of energy consumption.

According to an aspect of the invention, an ink jet printer that performs printing by discharging ink droplets from nozzles of an ink jet head onto a print medium includes: a moisture adjusting unit that is provided at a downstream side of the ink jet head in a print medium conveying direction and adjusts moisture of the print medium by moving moisture of a printing surface of the print medium, onto which the ink droplets are discharged from the ink jet head, to a surface opposite the printing surface; and a moisture adjustment control unit that controls moisture adjustment of the print medium performed by the moisture adjusting unit in accordance with a ratio of the number of nozzles, from which the ink droplets from the ink jet head are discharged, to the total number of nozzles.

The inventor obtained the following findings as a result of hard examination on curl of print media. That is, as the curl of print medium, there are two kinds of curl including curl when ink droplets are discharged, that is, curl immediately after printing and curl occurring after the ink droplets are dried. The directions of two kinds of curl are generally opposite to each other. In addition, the direction of curl depends on the direction of cellulose fibers that form the print medium. In addition, it is possible to effectively prevent the curl of a print medium from occurring by reducing a difference of moisture between the printing surface, onto which ink droplets are discharged, and the surface opposite the printing surface. On the other hand, in the case when the amount of ink discharged onto a sheet of print medium is small, the curl does not occur.

According to the invention described above, the moisture of the print medium is adjusted by the moisture adjusting unit when the amount of ink discharged onto a sheet of print medium is large. As a result, it becomes possible to prevent occurrence of the curl of the print medium while suppressing the energy consumption.

In addition, the moisture adjusting unit may reduce a difference of moisture between the printing surface of the print medium, onto which the ink droplets are discharged from the ink jet head, and the surface opposite the printing surface.

In addition, the moisture adjusting unit may include: a heating portion that heats the printing surface of the print medium, onto which the ink droplets are discharged from the ink jet head; and a suction portion that generates a flow of air in the direction from the printing surface of the print medium to the surface opposite the printing surface.

In addition, the heating portion may supply heated air onto the printing surface of the print medium.

According to the invention described above, vapor of ink generated when heating the print surface of the print medium moves toward the surface opposite the printing surface through the inside of the print medium. As a result, the difference of moisture between the printing surface of the print medium and the opposite surface thereof is effectively decreased.

In addition, a pair of bored conveyance belts that convey the print medium in a state in which the print medium is pinched between the heating portion and the suction portion may be further included, and holes of the pair of bored conveyance belts may be shifted from each other.

According to the invention described above, it is possible to effectively decrease the difference of moisture between the printing surface of the print medium and the opposite surface thereof by increasing the length of the flow of ink vapor passing through the inside of the print medium.

In addition, the suction portion may be a bored rotation drum rotating in a state in which the print medium is attracted on an outer periphery thereof by sucking air from the inside, and the heating portion may be provided at an outer side of the outer periphery of the bored rotation drum.

According to the invention described above, it is possible to effectively decrease the difference of moisture between the printing surface of the print medium and the opposite surface thereof and to turn the print medium over by discharging the print medium when the bored rotation drum is half rotated.

In addition, the heating portion may be configured to include a heating roller that rotates in contact with the printing surface of the print medium, onto which the ink droplets are discharged from the ink jet head, and the print medium may be transported in a state in which the print medium is pinched between the heating roller and a pressure roller provided opposite the heating roller.

According to the invention described above, it is possible to more effectively decrease the difference of moisture between the printing surface of the print medium and the surface opposite the printing surface with the help of vaporization of ink.

In addition, the moisture adjustment control unit may cause the moisture adjusting unit to perform moisture adjustment of the print medium when the ratio of the number of nozzles, from which the ink droplets are discharged, to the total number of nozzles is a predetermined ratio or more.

According to the invention described above, it is possible to suppress the energy consumption while preventing occurrence of curl after drying.

BRIEF DESCRIPTION OF THE DRAWINGS

FIG. 3 illustrates the configuration of a heating portion shown in FIG. 2.

FIG. 4 illustrates the configuration of a suction portion shown in FIG. 2.

FIG. 7 illustrates discharge curl.

FIG. 8 illustrates permanent curl.

FIG. 11 illustrates the configuration of a moisture adjusting unit shown in FIG. 10.

FIG. 14 illustrates the configuration of a second moisture adjusting unit shown in FIG. 13.

DESCRIPTION OF EXEMPLARY EMBODIMENTS

Hereinafter, a first embodiment of the invention will be described with reference to the accompanying drawings.

Figure 1:
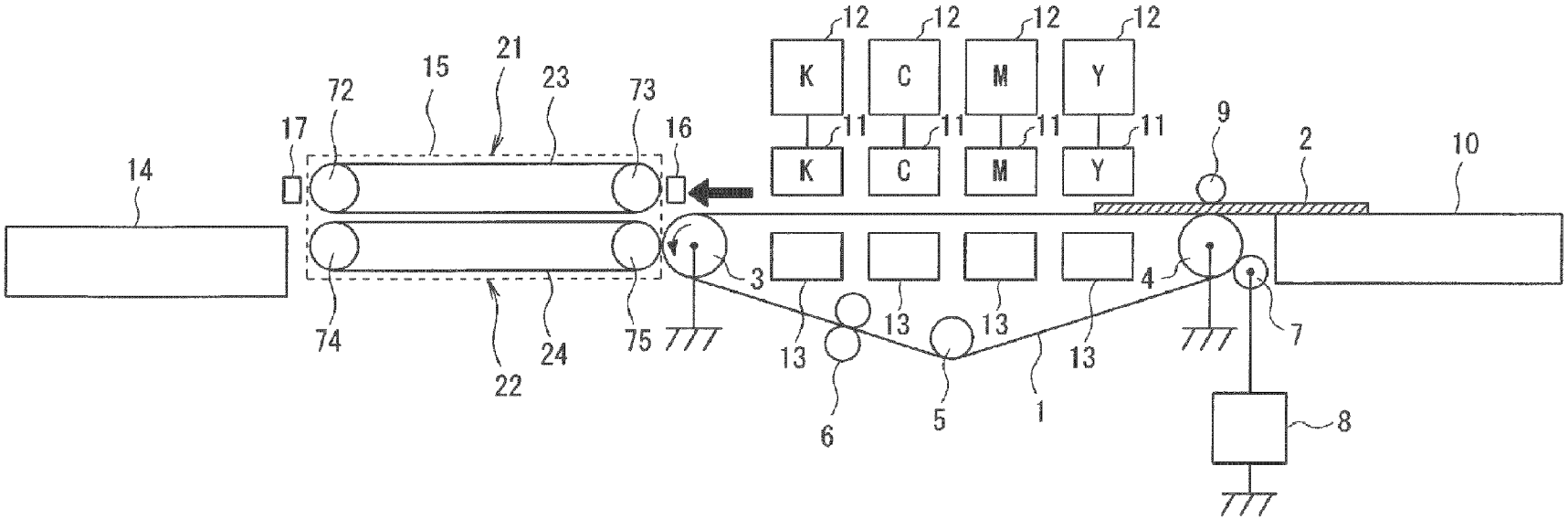
FIG. 1 is a front view schematically illustrating the configuration of an ink jet printer according to a first embodiment of the invention.

FIG. 1 is a front view schematically illustrating the configuration of an ink jet printer according to the first embodiment. Reference numeral 1 in the drawing denotes a transport belt for transporting a print medium 2. In addition, a polyimide, a polycarbonate, a PVDF (polyvinylidene fluoride) an ETFE (tetrafluoroethylene ethylene copolymer), a PPFA (tetrafluoroethylene perfluoroalkylvinylether copolymer), an FEP (tetrafluoroethylene hexafluoroalkyl vinylether copolymer), a PCTFE (polychlorotrifluoroethylene), and a mixture of these materials and an elastomer may be appropriately used for the transport belt 1. Moreover, a single-layered belt made of the materials or a two-layered belt which is made of the materials and whose electric resistance is adjusted by adding a conductive material, such as carbon, may be used as the transport belt 1. The transport belt 1 is wound around a driving roller 3, a driven roller 4, and a tension roller 5. The driving roller 3 is driven to rotate in a direction indicated by an arrow shown in the drawing by means of a transport belt motor that is not shown and transports the print medium 2 from right to left in the drawing in a state in which the print medium 2 is electrostatically attracted on the transport belt 1 electrically charged by a charged roller, which will be described later. In addition, the driving roller 3 is grounded to eliminate electric charges of the transport belt 1. The driven roller 4 is grounded to apply a voltage in a state in which the transport belt 1 is pinched between the driven roller 4 and the charged roller, which will be described later. A tension roller 5 is biased downward by a spring that is not shown, such that a tension is applied to the transport belt 1. In addition, reference numeral 6 in the drawing denotes a belt cleaner serving to clean the transport belt 1 stained with the mist of ink discharged from an ink jet head, which will be described later. The belt cleaner 6 is a roller formed by using a felt, for example.

A charging roller 7 serving as a charging unit is in contact with the transport belt 1 so as to face the driven roller 4, and a high-voltage power supply 8 is connected to the charging roller 7. The charging roller 7 is disposed immediately before the paper feeding position of the print medium 2. Accordingly, when a current having an electric potential whose polarity is inverted every predetermined period is applied to the charging roller 7, a surface of the transport belt 1 is electrically charged (electrically charged in a stripe shape) to have an electric potential with an opposite polarity alternately along the transport direction. Then, due to the electric charges, dielectric polarization occurs in the print medium 2. A closed circuit including electric charges on the print medium 2 resulting from the dielectric polarization and electric charges on a surface of the transport belt 1 and electric charges on the transport belt 1 and electric charges on the print medium 2 adjacent thereto due to the dielectric polarization is formed to generate an electrostatic force, thereby causing the print medium 2 to be attracted on the surface of the transport belt 1. In addition, a charging pattern may be a stripe shape alternating in the transport direction of the print medium 2 and may also be a checkered shape, a stripe shape alternating in a direction crossing the transport direction of the print medium 2, and the like. In addition, an electric potential having the same polarity, that is, DC charging may be applied.

A paper pressure roller 9 is provided above the driven roller 4. The paper pressure roller 9 is biased downward by a spring that is not shown and has a function of causing the print medium 2, which is fed from a paper feed unit 10, to be pressed against the transport belt 1 on the driven roller 4. As described above, when the print medium 2 is placed on an outer peripheral surface of the electrically charged transport belt 1 and the print medium 2 is pressed against the transport belt 1 by means of the paper pressure roller 9, the print medium 2 is attracted on the outer peripheral surface of the transport belt 1 due to an electrostatic force. In addition, a moisture adjusting unit 15 is provided at a downstream side of the transport belt 1 in the transport direction of the print medium 2 and a paper discharge unit 14 serving to discharge the print medium 2 is provided at a downstream side of the moisture adjusting unit 15 in the transport direction of the print medium 2, such that the print medium 2 which is printed in a printing area and on which moisture adjustment has been performed is discharged. In addition, a first photosensor 16 that detects the print medium 2 is provided at an upstream side of the moisture adjusting unit 15 in the transport direction of the print medium 2, and a second photosensor 17 that detects the print medium 2 is provided at a downstream side of the moisture adjusting unit 15 in the transport direction of the print medium 2.

Reference numeral 11 shown in FIG. 1 denotes a line type ink jet head. The ink jet heads 11 are disposed to be shifted in the transport direction of the print medium 2 for four colors of yellow (Y), magenta (M), cyan (C), and black (K). To the ink jet heads 11, ink is supplied from ink cartridges 12 corresponding to colors of Y, M, C, and K through an ink supply tube. The ink jet head 11 include a plurality of nozzles formed in the direction crossing the transport direction of the print medium 2. A fine ink dot is formed on the print medium 2 by simultaneously discharging a required amount of ink droplets in a required part through the nozzles. By performing such process for every color, so-called one pass printing can be performed only by causing the print medium 2 attracted on the transport belt 1 to pass once. A region where the ink jet heads 11 are provided corresponds to a printing area.

A method of discharging ink from a nozzle of an ink jet head includes an electrostatic method, a piezoelectric method, a film-boiling jetting method, and the like. In the case of the electrostatic method, when a driving signal is applied to an electrostatic gap that is an actuator, a vibrating plate within a cavity vibrates to change a pressure in the cavity and ink droplets are discharged from nozzles due to the pressure change. In the case of the piezoelectric method, when a driving signal is applied to a piezoelectric element that is an actuator, a vibrating plate within a cavity vibrates to change a pressure in the cavity and ink droplets are discharged from nozzles due to the pressure change. In the case of the film-boiling jetting method, ink is instantaneously heated to 300° C. or more since a minute heater exists within a cavity. As a result, the ink changes to a film boiling state to generate bubbles, and ink droplets are discharged from nozzles due to the pressure change. The invention may be applied to any of the ink discharging methods described above.

Cleaning units 13 for recovering nozzles provided in the ink jet head 11 are provided below the ink jet heads 11 that form a printing area and inside the transport belt 1 that is wound. The cleaning unit 13 includes a cap capable of covering a nozzle surface of the ink jet head 11 in an airtight manner. An ink absorber is provided on a bottom of the cap and a negative pressure generating unit, such as a tube pump, is connected. In addition, the cleaning unit 13 moves up and down by an up-and-down unit that is not shown.

In an ink jet printer including the line type ink jet heads 11 described above, an ink droplet discharge trouble (no discharge) that ink droplets are not discharged from nozzles of the ink jet heads 11, that is, a dot missing phenomenon may occur due to causes, such as ink disconnection, occurrence of bubbles, clogging (drying), and attachment of paper particles. The paper particles are easily generated when a print medium using wood pulp as a raw material rubs against and is in contact with a roller and the like. The paper particle forms a part of the print medium and means a fibrous element or a group of fibrous elements.

If a cap of the cleaning unit 13 is raised by the up-and-down unit so as to come in contact with a nozzle surface of the ink jet head 11 and the inside of the cap is changed to a negative pressure state by a negative pressure generating unit, ink is sucked from a nozzle and is then collected in the cap. The nozzle is recovered by sucking the ink collected in the cap using the negative pressure generating unit and discharging the ink to a waste ink tank that is not shown. Such a nozzle recovery method is referred to as cleaning. On the other hand, a nozzle may be recovered only by discharging ink droplets in reserve without performing the suction. Such a nozzle recovery method is referred to as flushing.

In the case of flushing, since it is not necessary to make the cap of the cleaning unit 13 come in contact with the nozzle surface of the ink jet head 11, the flushing is performed without raising the cap. That is, the nozzle surface of the ink jet head 11 and the cap of the cleaning unit 13 are positioned with the transport belt 1 interposed therebetween in front view. Accordingly, a nozzle recovery opening for causing ink discharged from the nozzle of the ink jet head 11 to pass toward the cap of the cleaning unit 13 is provided in the transport belt 1. The nozzle recovery opening is formed to face the ink jet head 11 at predetermined timing while the transport belt 1 goes around. Specifically, the nozzle recovery opening is formed at the position simultaneously facing the plurality of ink jet heads 11 provided in a zigzag pattern. Thus, nozzle recovery processing for all nozzles can be performed simultaneously by performing clogging prevention discharge at predetermined timing while the transport belt 1 goes around.

Figure 2:
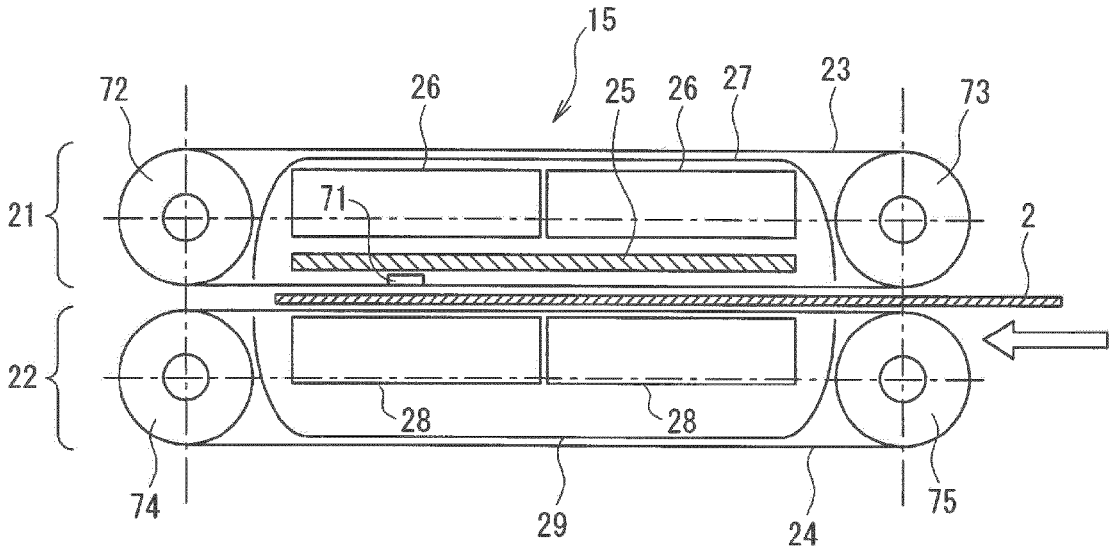
FIG. 2 is a front view illustrating the configuration of the moisture adjusting unit shown in FIG. 1.
Figure 3A:
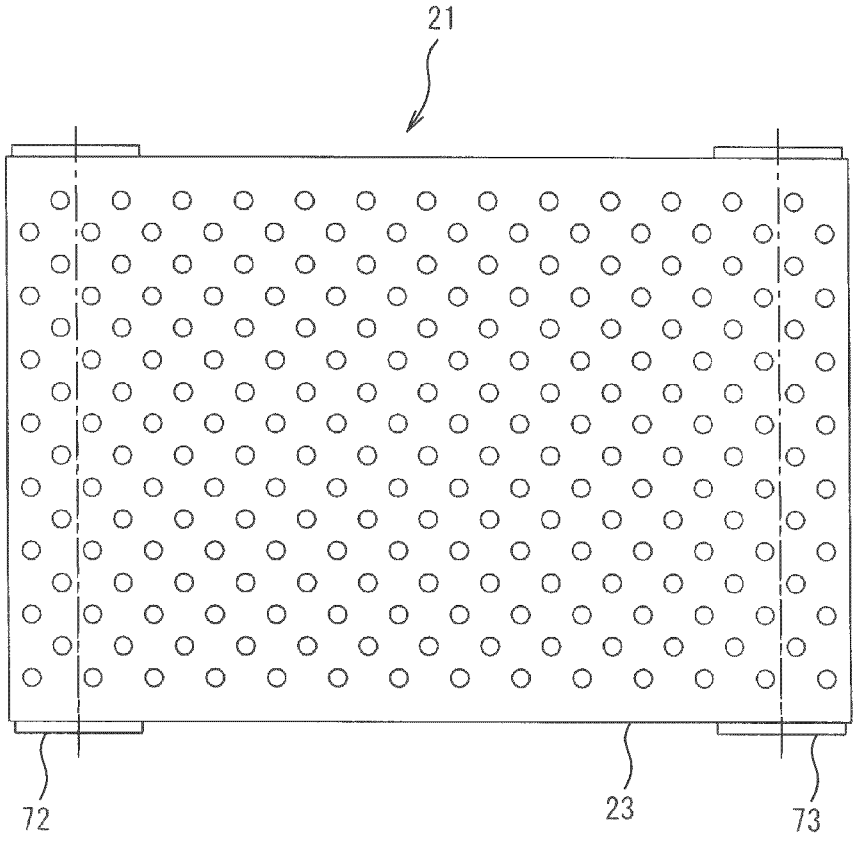
FIG. 3A is a plan view and FIG. 3B is a front view.
Figure 3B:
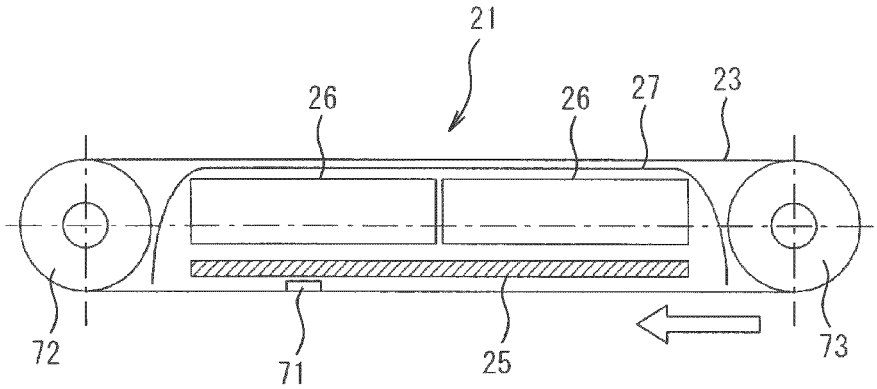
Figure 4A:
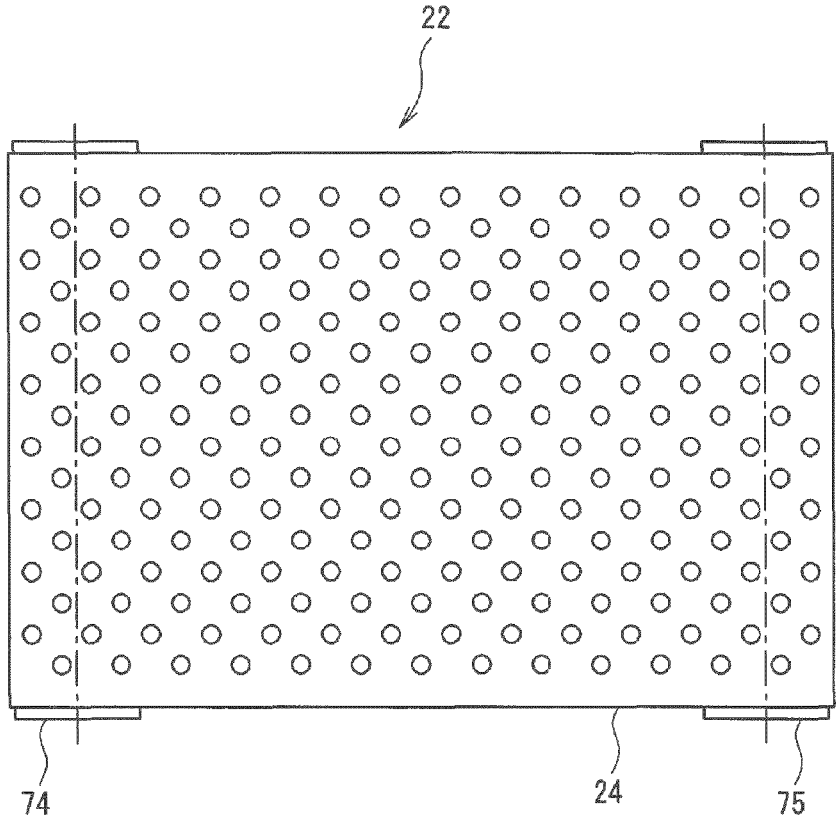
FIG. 4A is a plan view and FIG. 4B is a front view.
Figure 4B:
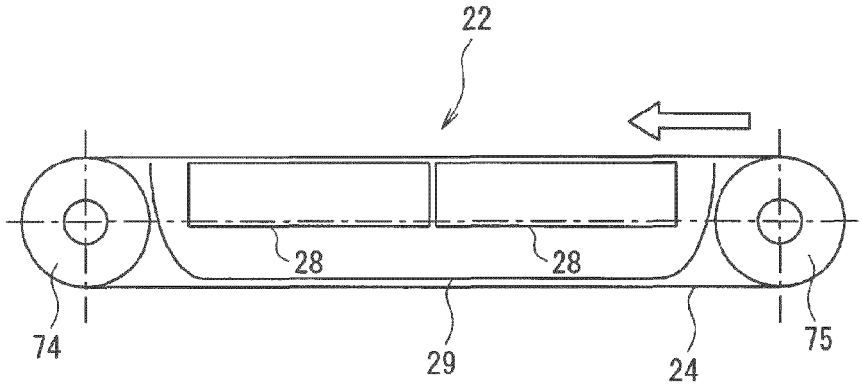

FIG. 2 is a view illustrating the entire configuration of the moisture adjusting unit 15. The moisture adjusting unit 15 in the first embodiment is configured to include a heating portion 21, which is positioned above a print medium transport line (indicating the same horizontal plane as an upper outer peripheral surface of the transport belt 1), and a suction portion 22 positioned below the print medium transport line. Details of the heating portion 21 are shown in FIG. 3, and details of the suction portion 22 are shown in FIG. 4. The heating portion 21 includes a heating unit 25 disposed immediately above the print medium transport line, a ventilation fan 26 disposed above by the heating unit 25, and an upper cover plate 27 that covers the ventilation fan 26 and the heating unit 25 from the above. Therefore, when the ventilation fan 26 is driven while generating heat with the heating unit 25, heated air is sprayed toward the print medium 2. In addition, reference numeral 71 in the drawing denotes a temperature sensor that detects the temperature of the air ventilated. The suction portion 22 includes a suction fan 28, which is disposed immediately below the print medium transport line, and a lower cover plate 29 that covers the suction fan 28 from the below. Accordingly, when the suction fan 28 is driven, the air around the print medium transport line is sucked.

An upper bored transport belt driving roller 72 is provided at a downstream side of the heating portion 21 in the print medium transport direction, an upper bored transport belt driven roller 73 is provided at an upstream side of the heating portion 21 in the print medium transport direction, and an upper bored transport belt 23 is wound around both the upper bored transport belt driving roller 72 and the upper bored transport belt driven roller 73, such that the heating portion 21 is placed within the upper bored transport belt 23. On the other hand, a lower bored transport belt driving roller 74 is provided at a downstream side of the suction portion 22 in the print medium transport direction, a lower bored transport belt driven roller 75 is provided at an upstream side of the suction portion 22 in the print medium transport direction, and a lower bored transport belt 24 is wound around both the lower bored transport belt driving roller 74 and the lower bored transport belt driven roller 75, such that the suction portion 21 is placed within the lower bored transport belt 24. As a result, the print medium transport line is interposed between a lower outer peripheral surface of the upper bored transport belt 23 and an upper outer peripheral surface of the lower bored transport belt 24. Accordingly, by rotating the upper bored transport belt 23 and the lower bored transport belt 24 in synchronization with each other, it is possible to transport the print medium 2 in a state in which the print medium 2 is interposed between the lower outer peripheral surface of the upper bored transport belt 23 and the upper outer peripheral surface of the lower bored transport belt 24.

Figure 5:
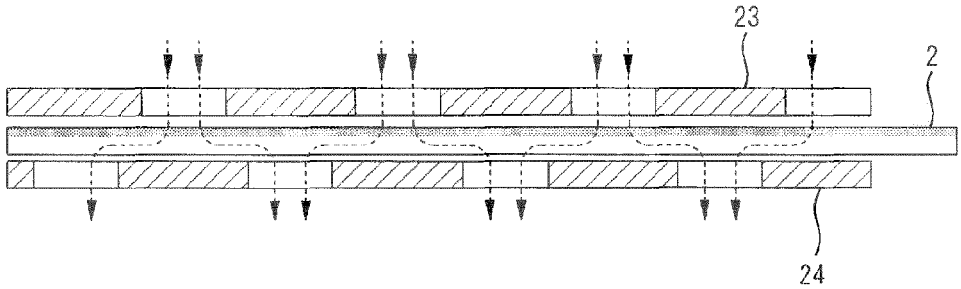
FIG. 5 is a view explaining an operation of the moisture adjusting unit shown in FIG. 2.

Details of holes of the upper bored transport belt 23 and the lower bored transport belt 24 near the print medium transport line are shown in FIG. 5. As is apparent from FIG. 2, the circumference of the upper bored transport belt 23 and the circumference of the lower bored transport belt 24 are equal to each other, and the upper bored transport belt 23 and the lower bored transport belt 24 rotate in synchronization with each other. In addition, as is apparent from FIGS. 3A and 4A, both holes of the upper bored transport belt 23 and holes of the lower bored transport belt 24 are provided at the same pitches in a zigzag pattern. However, as is apparent from FIG. 5, the holes of the upper bored transport belt 23 and the holes of the lower bored transport belt 24 are provided to be shifted from each other.

In FIG. 5, a state in which ink droplets are discharged from the ink jet heads 11 onto an upper surface of the print medium 2 so as to cause the upper surface of the print medium 2 to be wet is shown. As described above, heated air supplied from the heating portion 21 is sprayed onto a printing surface of the print medium 2 through holes of the upper bored transport belt 23 and heats and water-based ink on the printing surface to thereby vaporize the ink. Since the air near the print medium transport line is sucked by the suction portion 22, vapor of the water-based ink generated at a printing surface side of the print medium 2 moves to a surface opposite to the printing surface through the inside of the print medium 2 and is then sucked from the surface into the suction portion 22 through holes of the lower bored transport belt 24. That is, since the holes of the upper bored transport belt 23 through which the heated air is sprayed and the holes of the lower bored transport belt 24 through which water-based vapor is sucked are arrayed to be shifted from each other, the moving distance of the vapor increases. As a result, a moisture difference between a printing surface of the print medium 2 and an opposite surface thereof decreases.

Figure 6:
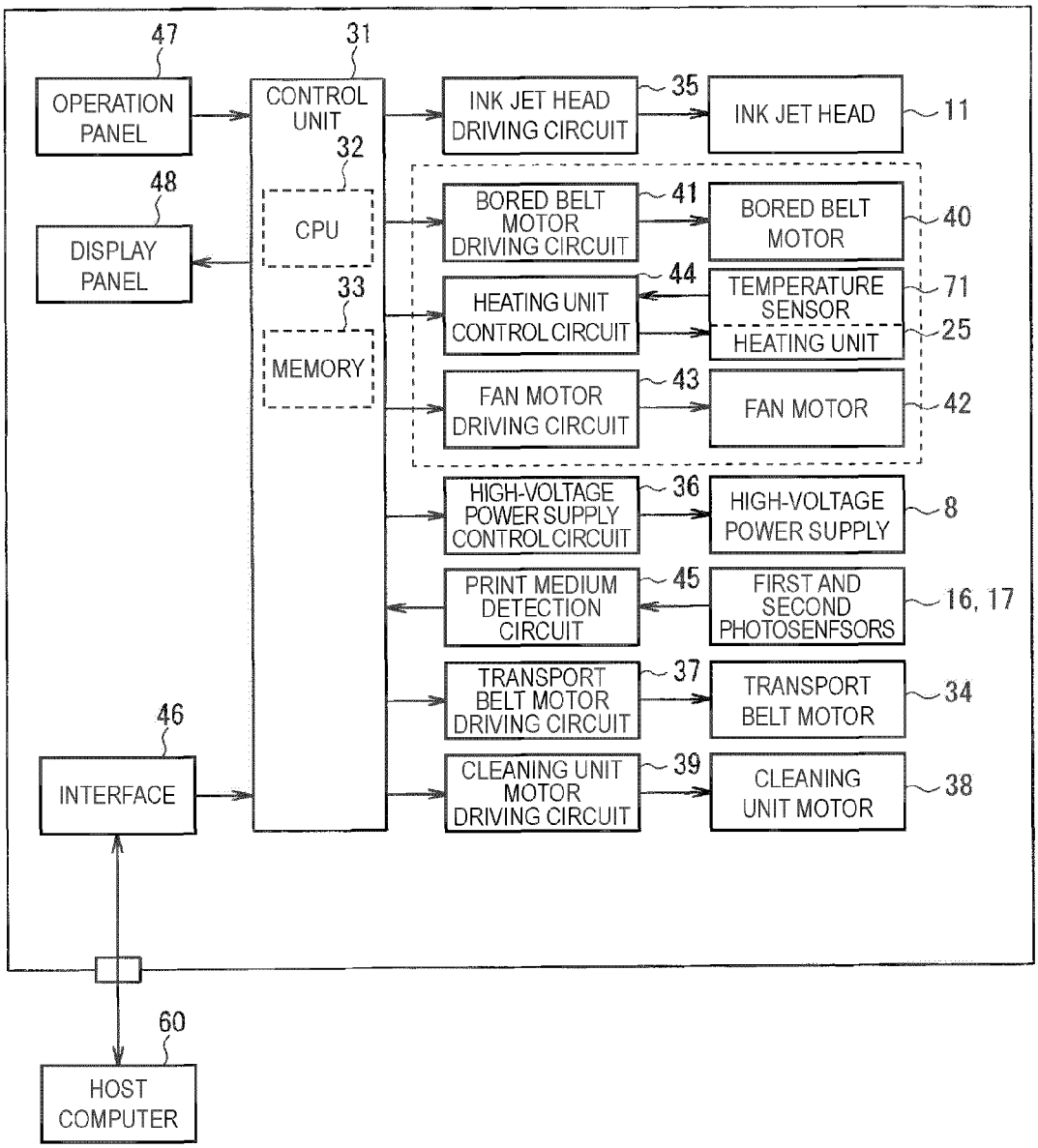
FIG. 6 is a block diagram illustrating the configuration of the ink jet printer shown in FIG. 1.

FIG. 6 illustrates the ink jet printer according to the first embodiment and a host computer 60 for driving the ink jet printer. The host computer 60 may be applied to all kinds of computer systems, such as a personal computer or a digital still camera. In an ink jet printer, a driving circuit for driving the ink jet printer and a detection circuit for reading a sensor output is provided. By using the driving circuit or the detection circuit, the ink jet printer is driven. That is, printing, cleaning, flushing, moisture adjustment of print medium, and the like are performed.

A computer system serving as an operation processing unit is provided within a control unit 31 serving to control driving of the ink jet printer. Accordingly, the control unit 31 includes a CPU 32, which serves as a central processing unit that performs various kinds of control and operation processing, and a memory 33, such as a RAM serving as a main memory or a ROM serving as a read only memory. As driving circuits, there are provided an ink jet head driving circuit 35 for driving the ink jet heads 11, a high-voltage power supply control circuit 36 for controlling the high-voltage power supply 8, a transport belt motor driving circuit 37 for driving a transport belt motor 34 used to drive the transport belt 1, a cleaning unit motor driving circuit 39 for driving a cleaning unit motor 38 used to drive the cleaning unit 13, a bored belt motor driving circuit 41 for driving a bored belt motor 40 used to drive the bored transport belts 23 and 24, and a fan motor driving circuit 43 for driving a fan motor 42 used to drive the ventilation fan 26 and the suction fan 28. In addition, as a detection circuit, for example, a print medium detection circuit 45 that detects the abnormality in transport of the print medium 2, so-called paper jam, using first and second optical sensors 16 and 17 is provided. In addition, a heating unit control circuit 44 that controls the heating unit 25 of the heating portion 21 on the basis of the detection temperature of a temperature sensor 71 is also provided. In addition, the control unit 31 is connected to the host computer 60 through an interface 46 and causes printing, cleaning, flushing, and the like to be performed according to an operation state of an operation panel 47 and an instruction of a program whose operation is processed by the host computer 60. In addition, various kinds of information resulting from printing or cleaning are displayed on a display panel 48.

Figure 7A:
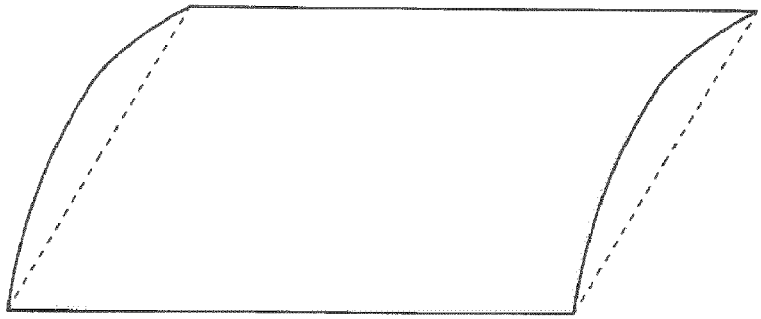
FIG. 7A is a view explaining a state in which the amount of curl is small and FIG. 7B is a view explaining a state in which the amount of curl is large.
Figure 7B:
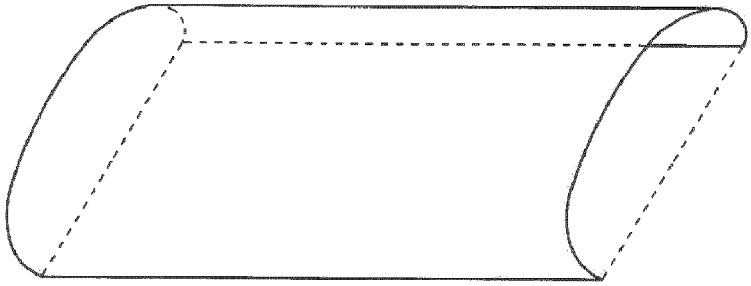

Next, an explanation on prevention of curl of the print medium 2 performed by the control unit 31 and the moisture adjusting unit 15 will be made. First, types and main causes of curl of the print medium 2 will be described. In the case of a line head type ink jet printer that uses water-based ink, ink droplets are discharged onto the print medium 2, which is regular paper not having an ink containing layer, within a short period of time. For this reason, since cellulose fibers that form the print medium 2 absorb a solvent of ink, the print medium 2 is swollen. As a result, the curl occurs immediately after printing, as shown in FIGS. 7A and 7B. This is defined as discharge curl. The degree of discharge curl increases as the amount of discharged ink per unit area increases. In addition, the degree of discharge curl is also dependent on the type of print medium. Moreover, the discharge curl occurs on the entire surface of the print medium 2 when the entire printing surface of the print medium 2 is printed and partially occurs when the print medium 2 is partially printed. In addition, the direction of the discharge curl is related to the paper milling direction (also referred to as a machine direction) in a process of manufacturing a print medium that is regular paper. Accordingly, the direction of the discharge curl is not related with whether the printing direction is a horizontal direction or a vertical direction.

Figure 8A:
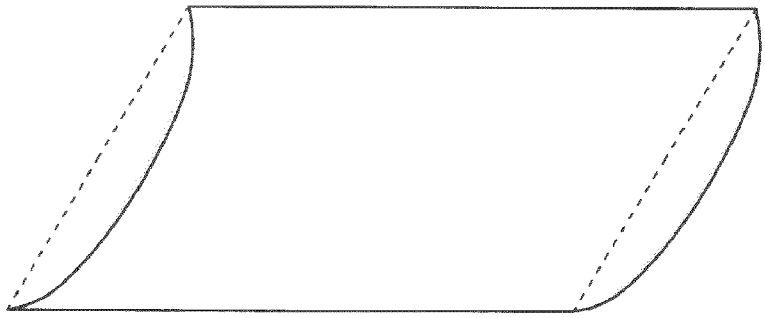
FIG. 8A is a view explaining a state in which the amount of curl is small and FIG. 8B is a view explaining a state in which the amount of curl is large.
Figure 8B:
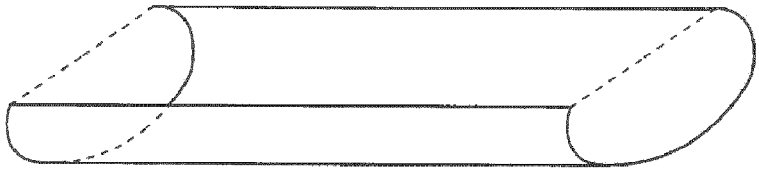

If the print medium in which the discharge curl has occurred is placed on a flat plate at the room temperature, the discharge curl is settled to be flat in about 10 seconds to 3 minutes. Then, as time goes by, the print medium is curled toward a side opposite the discharge curl while water, which is a solution in ink, is being evaporated. Then, in 24 hours when drying of moisture becomes approximately equal to the atmosphere, the curl occurs in the direction opposite the discharge curl as shown in FIGS. 8A and 8B. This curl is defined as permanent curl. The reason of occurrence of the permanent curl is concerned with a change in relative positions of cellulose fibers, for example, and will be described in detail later.

It was tested whether or not such curl is removed by heating a print medium. It was tested how the curl is removed by using a heating roller having a halogen lamp as a heating unit, causing the heating roller to face a pressure roller for forming a nip with a predetermined load, and transporting a print medium between the heating roller and the pressure roller at various speeds. The test was performed while changing the temperature of the heating roller and the transport speed with respect to a print medium that is printed in a so-called black solid type. The test result is shown in table 1.

TABLE 1

| | Temperature of heating roller (° C.) | Speed (mm/sec.) | Curl result |
|---|---|---|---|
| A | 25 | 10 | x |
| B | 25 | 150 | x |
| C | 80 | 10 | ○ |
| D | 80 | 150 | x |
| E | 150 | 10 | ○ |
| F | 150 | 150 | x |

From this test, it could be seen that both the discharge curl and the permanent curl were removed when heating was performed slowly.

Figure 9A:
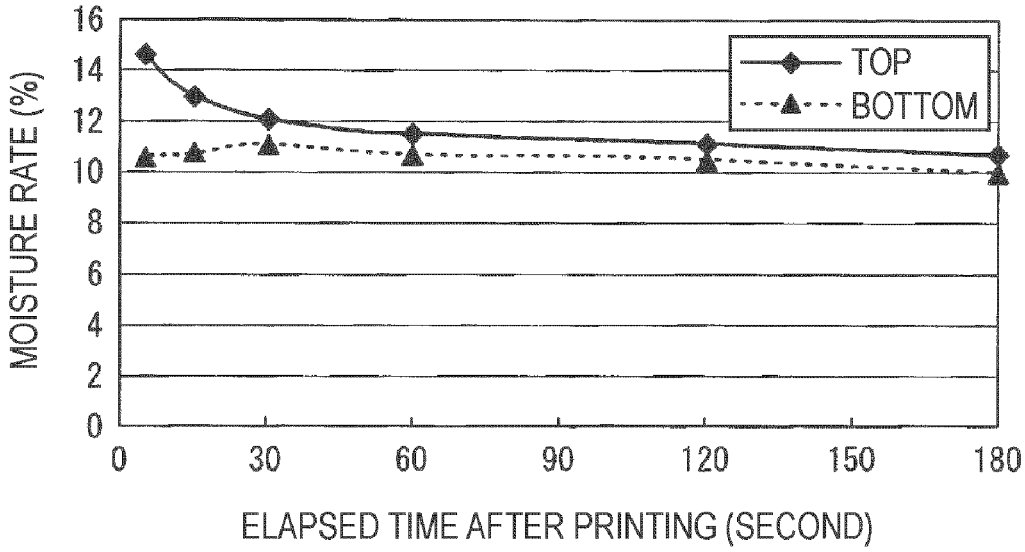
FIG. 9 is a view explaining moisture of top and bottom surfaces of a print medium on which printing has been completed.
Figure 9B:
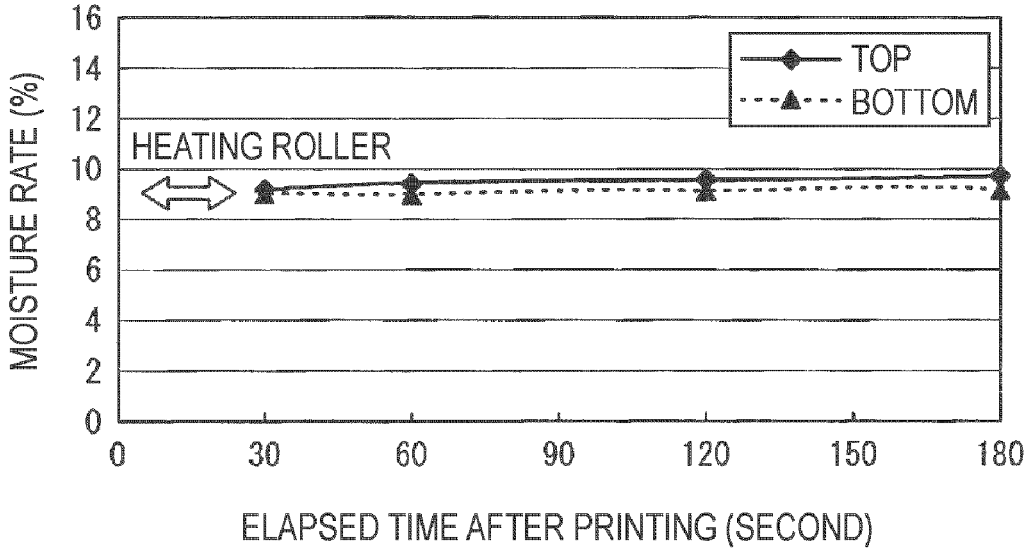

In addition, a change in moisture percentage of a printing surface of a print medium and a change in moisture percentage of a surface of the print medium opposite the printing surface in a drying process were measured by using an electric moisture percentage measuring apparatus (moisture meter MR-300 manufactured by Sanko Co. electronic lab, probe KG-PA, a moisture percentage measurement range: 3.5 to 40%). The test result is shown in FIGS. 9A and 9B. The measurement environment was as follows. That is, the temperature was 25° C., the humidity was 51%, and moisture percentages of top and bottom surfaces, that is, a printing surface and a surface opposite the printing surface of a print medium in an initial stage (before printing) print medium were 5.0%. Referring to FIG. 9A, a black solid pattern was printed by an ink jet head and placed at the room temperature so as to be dried, and then the moisture percentages of the top and bottom surfaces of the print medium were measured. The moisture percentage of the printing surface immediately after printing was 14.6%, and the moisture percentage of the opposite surface was 10.6%. Although both moisture percentages became closer in 30 seconds, there was always a difference of about 0.6 to 1.0%. Referring to FIG. 9B, a black solid pattern was printed by an ink jet head in the same manner as described above and transported between a heating roller having a temperature of 80° C. and a pressure roller so as to be dried, and then the moisture percentages of the top and bottom surfaces of the print medium were measured. In this case, a difference between moisture percentages of both surfaces was 0.5% or less immediately after the print medium passed the heating roller.

According to these test results described above, it is considered that the permanent curl decreases if a difference between moisture percentages of a printing surface and an opposite surface is small and the permanent curl increases if the difference between moisture percentages of the printing surface and the opposite surface is large. The reason may be explained as follows. That is, ink droplets are discharged onto a printing surface of a print medium and ink permeates into the printing surface of the print medium. The permeating depth depends on the amount of discharged ink per unit area. In the case when a print medium is regular paper of 64 g/m$^2$, the permeating depth is about 20 to 80% of the thickness of the print medium. The cellulose fiber that is mainly used to form a print medium absorbs water, which is a solvent of ink, and swells. In addition, hydrogen bond of a cellulose fiber surface before printing is released and the relative positions of cellulose fibers change. When the cellulose fiber swells, a ratio of the longitudinal direction and width direction of the cellulose fiber is about 1:20. That is, a change in the width direction is noticeably larger than a change in the longitudinal direction. Even though the orientation of cellulose fibers of a print medium is approximately equal, the cellulose fibers are oriented slightly in the machine direction in a process of paper making. As a result, since the print medium swells in a cross machining direction perpendicular to the machining direction, the discharge curl occurs to be curled toward a printing surface side. The thinner the print medium, the larger the discharge curl. In addition, for example, when an ink containing layer is coated on a printing surface of a print medium, the discharge curl is reduced.

Then, the moisture, which is a solvent of ink, is mainly evaporated from the printing surface of the print medium. As a result, swelling of the cellulose fiber slightly decreases and the curl amount of discharge curl decreases. Moreover, since the swelling of the cellulose fiber decreases as the moisture is evaporated, the relative positions of cellulose fibers are changed again. The amount of moisture contained in a print medium ends up with a state equal to the moisture contained in the surrounding air. Since the cellulose fibers are positioned such that the density of cellulose fibers increases in this drying process, a printing surface contracts more than a state before printing. As a result, the print medium is curled toward a side opposite the printing surface. In the case of noticeable permanent curl, a print medium is curled in a cylindrical shape, and accordingly, a commercial value thereof significantly decreases.

In a portion of a print medium, which was provided for the test, pinched between a heating roller and a pressure roller, the moisture which is a solvent of ink is heated and a part of the moisture permeates into a surface of the print medium opposite a printing surface instead of vapor. Assuming that the molecular weight of gas is M, a gas constant is R, and the absolute temperature is T, the average movement speed V of the gas is expressed as $V=(RT/M)^{1/2}$. For example, the average movement speed of vapor is 368 (m/sec) at 20° C., 380 (m/sec) at 40° C., and 392 (m/sec) at 60° C. The movement speed of vapor which is gas is significantly higher than that of water that is liquid.

As described above, since both the discharge curl and the permanent curl are caused by a difference of moisture between a printing surface of a print medium and an opposite surface thereof, it is possible to remove the curl in a method of vaporizing moisture, which is a solvent of ink, by heating a printing surface after printing and then urging the vapor to permeate up to the surface opposite the printing surface. However, since the actual transport speed of a print medium in a line head type ink jet printer is quite faster than 10 mm/sec, it is not sufficient for preventing the generation of curl only to transport the print medium in a state in which the print medium is pinched between the heating roller and the pressure roller.

Therefore, as shown in FIGS. 2 and 5, the air heated from the heating device 21 provided in an upper portion of the moisture adjusting unit 15 is sprayed onto the printing surface of the print medium 2 immediately after printing so as to heat the surface, and at the same time, the air around the print medium transport line is sucked and the print medium 2 is sucked toward the lower bored transport belt 24 by generating a negative pressure with the suction device 22 provided in a lower portion of the moisture adjusting unit 15. Since the print medium 2 after printing is heated from the printing surface side, moisture that is a solvent of ink changes to vapor, which easily moves. The vapor emitted to the air around the print medium transport line is discharged from a hole of the lower bored transport belt 24 by means of the suction fan 28, and the vapor remaining in the print medium 2 moves to the surface opposite the printing surface of the print medium 2. As a result, since the difference of moisture between the printing surface of the print medium and the opposite surface thereof decreases and both a degree of swelling of cellulose fibers and a degree of contraction of swelled cellulose fibers decreases, both the discharge curl and the permanent curl decreases. In addition, in the ink jet printers disclosed in JP-A-10-151733, JP-A-2005-178251, and JP-A-2005-178252 in which the moisture is applied on the opposite surface of the printing surface, it takes a lot of time to dry a print medium since the moisture increases in the entire print medium. Accordingly, it is not possible to cope with the high-speed printing described above.

The temperature of heated air sprayed onto the printing surface of the print medium 2 is preferably 40 to 100° C., even though the temperature also depends on the surrounding temperature and humidity. In the case when the temperature of heated air sprayed onto the printing surface of the print medium 2 is less than 40° C., the vaporized amount of moisture that is a solvent of ink, that is, the amount of generation of vapor is small. Accordingly, an effect of curl prevention is small. In contrast, if the temperature of heated air sprayed onto the printing surface of the print medium 2 is too high, the curl occurs due to the high-temperature vapor. When the high-temperature vapor is sprayed onto a printing surface of a white print medium that is not printed, curl occurs toward a surface opposite the printing surface (printing surface is an upper surface) and this state is maintained even in 24 hours, as shown in FIG. 8. In addition, the temperature of heated air sprayed onto the printing surface of the print medium 2 needs to be set to be equal to or smaller than the heat-resistant temperature of the bored transport belts 23 and 24. In addition, since the curl is also related with the transport speed of a print medium, it is preferable to set the temperature of heated air to a relatively high temperature in the case of transporting the print medium in a relatively high speed and to a relatively low temperature in the case of transporting the print medium in a relatively constant speed. However, it is necessary to select the suitable temperature in consideration of the surrounding heat capacity and the like. In addition, since ink of nozzles of an ink jet head is dried when the air heated in the moisture adjusting unit 15 is sprayed onto the ink jet head, it is preferable to collect the heated air within the moisture adjusting unit 15.

Next, a ratio (hereinafter, also referred to as a printing rate) of the number of nozzles from which ink droplets are discharged to the total number of nozzles will be described. First, an ink droplet that is a basis of so-called solid printing is set according to the printing resolution or a print medium. In the case when the printing resolution is 360 dpi in the vertical direction and 360 dpi in the horizontal direction, and regular paper which does not have an ink containing layer is used as a print medium, and ink is pigment ink, a minimum state of the ink drop weight X (ng) when a printing surface of the print medium is completely printed, so-called beta printing is performed by discharging the weight X (ng) of the ink droplet from all nozzles is defined as 100% of a printing rate. In order to set the printing rate to 100% in four color printing, a printing rate of each color may be set to 25% to thereby obtain 100% in total or 30% of yellow, 20% of magenta, 30% of cyan, and 20% of black may be applied to thereby obtain 100% in total. In the case when an L dot, an M dot, and an S dot are set to X (ng), 2X/3 (ng), and X/3 (ng), respectively, in an ink jet head capable of controlling the size of an ink droplet, a printing rate when printing total dots by using the M dots is 100×⅔=66.7% and a printing rate when printing the total dots by using the S dots is 100×⅓=33.3%. In addition, the allowable printing rate varies according to the type of a print medium or ink, whether or not double-sided printing is performed, and the like. In the case of single-sided printing, printing corresponding to a printing rate of about 100 to 200% is generally possible. However, since the allowable printing rate changes according to determination of the printing quality, the allowable printing rate may be changed according to an ink jet printer.

Using the concept of the printing rate, a minimum value of a printing rate at which permanent curl in single-sided printing occurred was first obtained by a test. As a result, the permanent curl did not almost occur in the case when the printing rate is less then 40%, but the permanent curl almost occurred in the case when the printing rate is 40% or more. Here, the reason why the 'almost' is used is that states of occurrence of permanent curl are different in a case of performing average printing on a print medium and a case of performing local printing even if the printing rate is the same. Then, as shown in table 2, it was possible to prevent the occurrence of permanent curl by performing a moisture adjustment when the printing rate in the single-sided printing was 40% or more using the moisture adjusting unit 15.

TABLE 2

| Case | 1 | 2 |
|---|---|---|
| Printing rate (%) | Less than 40 | 40 or more |
| Moisture adjustment | None | Done |

Next, a minimum value of a printing rate at which permanent curl in double-sided printing occurred was obtained by a test. As a result, the permanent curl did not almost occur in the case when the printing rate is less then 40%, and the permanent curl almost occurred in the case when the printing rate of one of top and bottom surfaces or the printing rates of both the top and bottom surfaces are 40% or more. The reason of the 'almost' is as described above. Then, as shown in table 3, it was possible to prevent the occurrence of permanent curl by performing a moisture adjustment on a surface having a corresponding printing rate when the printing rate of either surface is 40% or more and the printing rates of both surfaces are 40% or more in double-sided printing using the moisture adjusting unit 15.

TABLE 3

| Case | 3 | 4 | 5 | 6 |
|---|---|---|---|---|
| Printing rate of top surface (%) | Less than 40 | Less than 40 | 40 or more | 40 or more |
| Moisture adjustment of top surface | None | None | Done | Done |
| Printing rate of bottom surface (%) | Less than 40 | 40 or more | Less than 40 | 40 or more |
| Moisture adjustment of bottom surface | None | Done | None | Done |

In addition, the control unit 31 causes the moisture adjusting unit 15 to perform the moisture adjustment on a printing surface having a printing rate of 40% or more. In addition, in the case of a transport trouble of a print medium in the moisture adjusting unit 15, so-called paper jam, a time taken when the print medium passes between the first photosensor 16 and the second photosensor 17 is monitored. If the time taken for the passing is equal to or larger than a predetermined time, it is determined to be paper jam and heating of the heating unit 25 is stopped.

Thus, in the ink jet printer according to the first embodiment, the moisture adjusting unit 15 that moves moisture of a printing surface of the print medium 2, onto which ink droplets are discharged from the ink jet heads 11, to a surface opposite the printing surface in order to adjust the moisture of the print medium 2 is provided at the downstream side of the ink jet heads 11 in the print medium transport direction and the moisture adjustment of the print medium 2 is performed according to a ratio of the number of nozzles, from which ink droplets are discharged from the ink jet heads 11, to the total number of nozzles, that is, a printing rate by means of the moisture adjusting unit 15. The moisture adjusting unit 15 makes an adjustment such that a difference of moisture between the printing surface of the print medium 2 and the opposite surface thereof decreases. When the ratio of the number of nozzles, from which ink droplets are discharged, to the total number of nozzles, that is, the printing rate is equal to or larger than a predetermined ratio, that is, when the amount of ink discharged onto a sheet of print medium 2 is large, the moisture adjusting unit 15 adjusts the moisture of the print medium 2. In such a manner, it is possible to prevent the occurrence of curl of the print medium 2 while suppressing the amount of energy consumption.

In addition, since the difference of moisture between the printing surface of the print medium 2, onto which ink droplets are discharged from the ink jet heads 11, and the opposite surface thereof decreases due to the moisture adjusting unit 15, the occurrence of curl of the print medium 2 can be effectively prevented.

In addition, since the flow of air is made to occur in the direction from the printing surface of the print medium 2 to the opposite surface thereof while heating the printing surface of the print medium 2 onto which ink droplets are discharged from the ink jet heads 11, vapor of ink generated when heating the print surface of the print medium 2 moves toward the surface opposite the printing surface through the inside of the print medium 2. As a result, the difference of moisture between the printing surface of the print medium 2 and the opposite surface thereof decreases.

In addition, since heated air is supplied onto the printing surface of the print medium 2, the difference of moisture between the printing surface of the print medium 2 and the opposite surface thereof can be efficiently decreased with the help of a flow of air caused by the suction device 22.

In addition, a pair of two bored transport belts 23 and 24 that transport a print medium pinched between the heating device 21 and the suction device 22 are provided and holes of the transport belts 23 and 24 are shifted from each other. As a result, since the length of the flow of ink vapor passing through the inside of the print medium 2 is increased, it is possible to effectively decrease the difference of moisture between the printing surface of the print medium 2 and the opposite surface thereof.

In addition, assuming that a minimum value of a ratio, at which the print medium 2 is curled when the printing-completed print medium 2 is dried, of the ratio of the number of nozzles from which ink droplets are discharged to the total number of nozzles is a predetermined ratio, the moisture adjusting unit 15 performs the moisture adjustment on the print medium 2 when the ratio of the number of nozzles from which ink droplets are discharged to the total number of nozzles is equal to or larger than the predetermined ratio. Accordingly, it is possible to suppress the energy consumption while preventing the occurrence of curl after drying.

Figure 10:
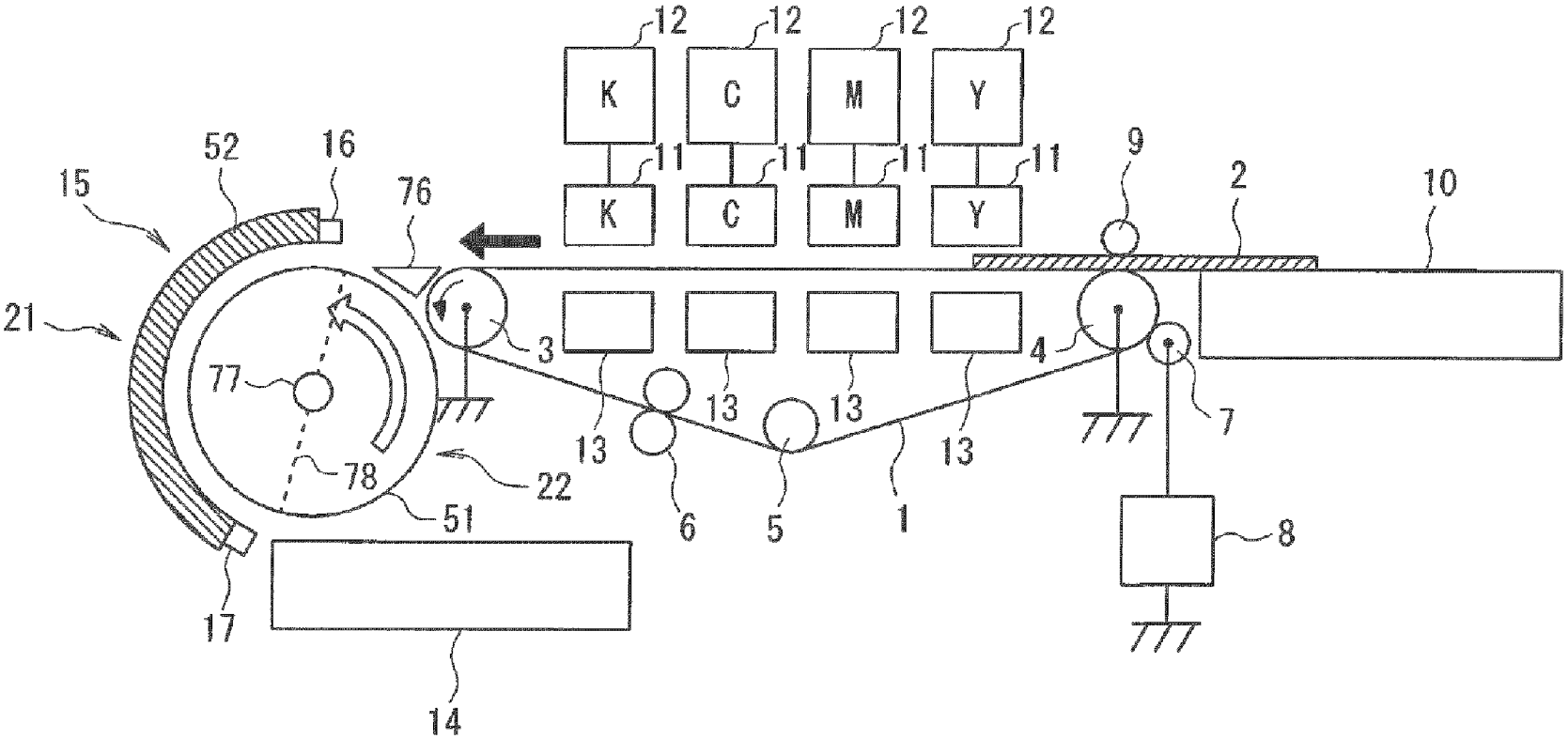
FIG. 10 is a front view schematically illustrating the configuration of an ink jet printer according to a second embodiment of the invention.

Next, a second embodiment of the invention will be described. FIG. 10 is a front view schematically illustrating the configuration of an ink jet printer according to the second embodiment. Many constituent members herein are equal to those in the ink jet printer according to the first embodiment shown in FIG. 1. Therefore, the same constituent members are denoted by the same reference numerals, and a detailed explanation thereof will be omitted.

In the second embodiment, the configuration of the moisture adjusting unit 15 that adjusts the moisture of the print medium 2 is changed as compared with the first embodiment. However, there is no change in that the printing surface side of the print medium 2 corresponds to the heating device 21 and the opposite side thereof corresponds to the suction device 22. In the second embodiment, the suction device 22 is formed by using a bored rotation drum 51 having holes formed on an outer peripheral surface thereof, and an upper end portion of the bored rotation drum 51 matches a print medium transport line. Details of the bored rotation drum 51 are shown in FIG. 11. The bored rotation drum 51 is configured to include a bored cylindrical portion 51*a* that forms an outer peripheral surface, a cylindrical bored rotation shaft 51*b* fitted to a cylindrical suction shaft 77, a plurality of spokes 51*c* that connect the bored rotation shaft 51*b* with the bored cylindrical portion 51*a* at both ends in the axis direction, and a flange 51*d* that cover both the ends in the axis direction. At an inner side between both the ends in the axis direction of the bored rotation drum 51, a plurality of holes (not shown) are also provided in a portion facing a heating unit, which will be described later, on a peripheral wall of the cylindrical suction shaft 77. One end of the suction shaft 77 is blocked and the other end is connected to a suction fan that is not shown. In addition, a cover plate 78 that separates a portion facing to a heating device 21, which will be described later, from the other portions is fixed on the suction shaft 77 inside the bored rotation drum 51. In addition, the rotation shaft 51*b* of the bored rotation drum 51 is connected to a drum motor that is not shown.

Figure 11A:
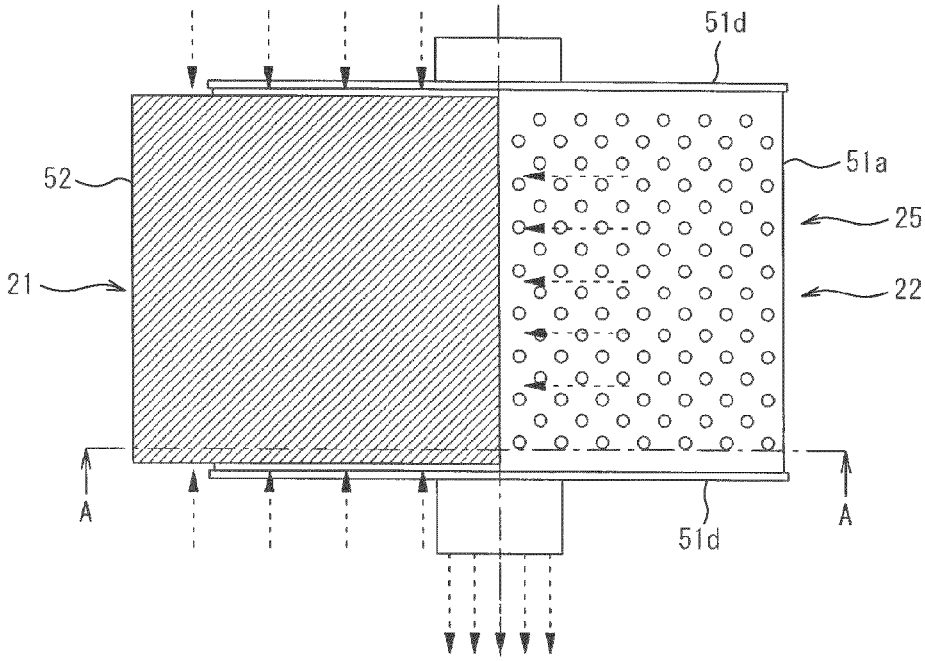
FIG. 11A is a plan view and FIG. 11B is a cross-sectional view taken along the line A-A of FIG. 11A.
Figure 11B:
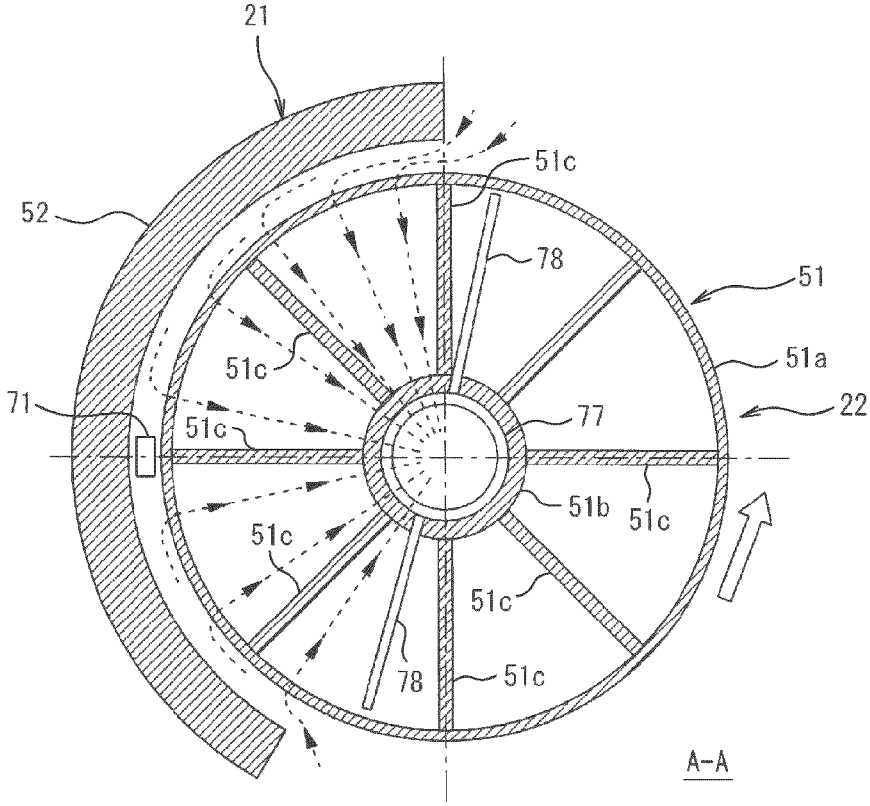

On the other hand, a heating unit 52 that forms the heating device 21 is provided on an outer peripheral surface of the bored rotation drum 51 so as to cover a left half shown in FIG. 10 or 11A. In addition, similar to the first embodiment, a first photosensor 16 is provided at an upstream side of the heating unit 52 in the print medium transport direction, a second photosensor 17 is provided at a downstream side of the heating unit 52 in the print medium transport direction, and a temperature sensor 71 is provided inside the heating unit 52. In addition, between the bored rotation drum 51 and the transport belt 1 serving to discharge the print medium 2 from a printing area, a transferring member 76 that causes the print medium 2 between the bored rotation drum 51 and the transport belt 1 to be smoothly transferred is provided.

Therefore, when a suction fan is driven, air in a portion existing between an outer peripheral surface of the bored rotation drum 51 and an inner side surface of the heating unit 52 of the heating device 21 is sucked through the suction shaft 77 and the inside of the bored rotation drum 51, and the sucked air is filled up from the outside. Accordingly, a surface of the print medium 2 opposite a printing surface, which is transported from the transport belt 1 to the outer peripheral surface of the bored rotation drum 51 through the transferring member 76, is attracted onto the outer peripheral surface of the bored rotation drum 51. In this state, when the bored rotation drum 51 is rotated in the arrow direction shown in FIG. 10 or 11B by means of a drum motor, the print medium 2 is half rotated in a state where the print medium 2 is attracted from the print medium transport line onto the outer peripheral surface of the bored rotation drum 51 and is then transported to a discharge portion 14 positioned below the bored rotation drum 51. When the print medium 2 is transported up to the position of the discharge portion 14 in the state where the print medium 2 is attracted on the outer peripheral surface of the bored rotation drum 51, the flow of air is occluded by the cover plate 78. As a result, the print medium 2 is detached from the outer peripheral surface of the bored rotation drum 51 to be then discharged to the discharge portion 14. At this time, since the printing surface of the print medium 2 is positioned downward, so-called reverse discharge (also referred to as face-down discharge) becomes possible. If a next print medium transport line is formed in the reverse discharge part, printing onto a surface opposite the printing surface on which printing has been completed, that is, double-sided printing becomes possible.

The printing surface of the print medium 2, which has been rotated and transported in a state in which the print medium 2 is attracted on the outer peripheral surface of the bored rotation drum 51, is heated by the heating unit 52 of the heating device 21. In the printing-completed printing surface of the heated print medium 2, water-based ink is vaporized, and the vapor moves to a surface opposite the printing surface through the inside of the print medium 2 and is then sucked to the suction device 22 through a hole of the bored rotation drum 51. As a result, since a difference of moisture between the printing surface of the print medium 2 and the opposite surface thereof decreases, occurrence of permanent curl is prevented.

Figure 12:
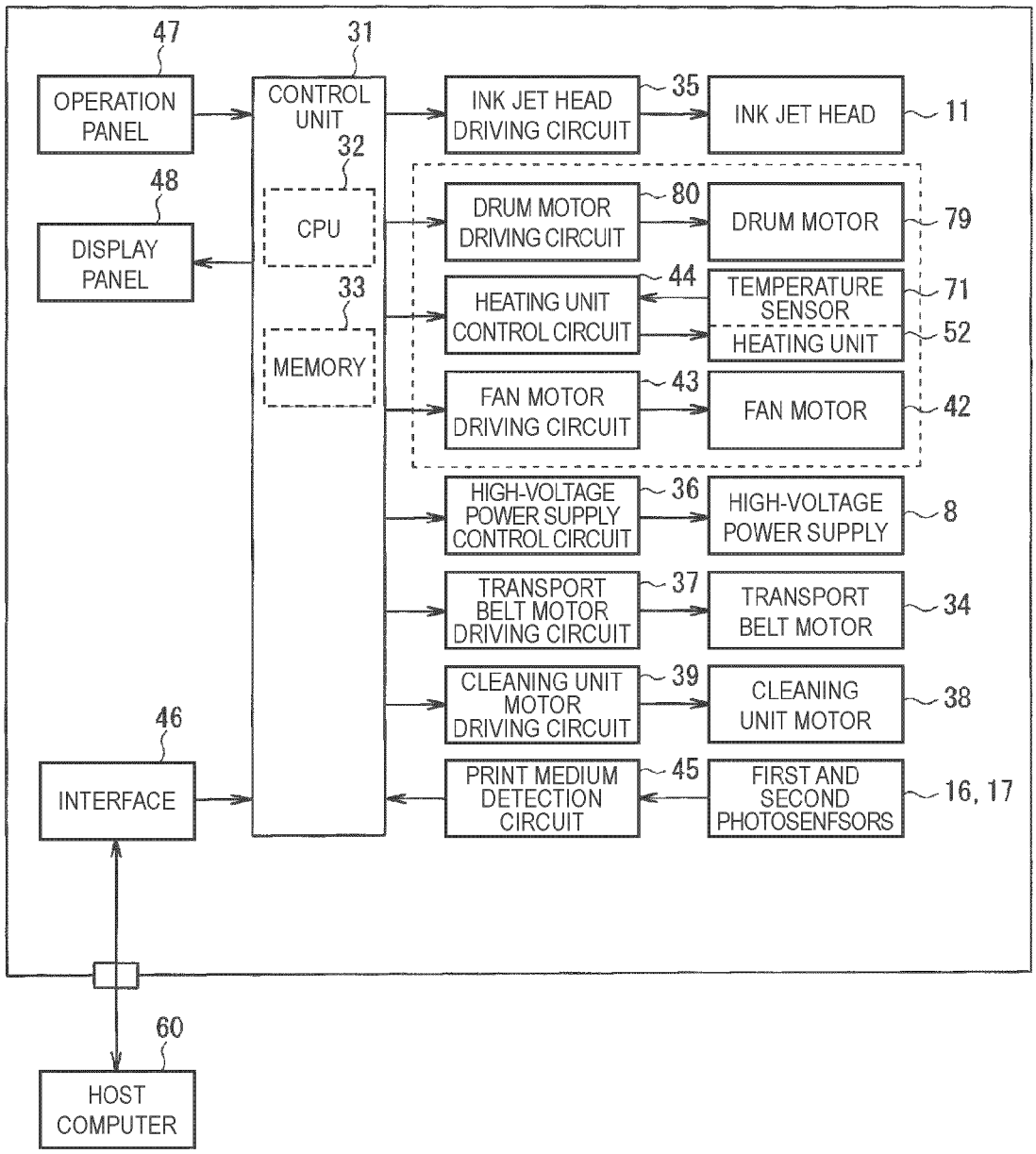
FIG. 12 is a block diagram illustrating the configuration of the ink jet printer shown in FIG. 10.

FIG. 12 illustrates the ink jet printer according to the second embodiment and the host computer 60 for driving the ink jet printer. Many functional blocks in the ink jet printer according to the second embodiment are equal to those in the ink jet printer according to the first embodiment shown in FIG. 6. Therefore, the same functional blocks are denoted by the same reference numerals, and a detailed explanation thereof will be omitted. In the second embodiment, the bored belt motor 40 in the first embodiment shown in FIG. 6 is changed to a drum motor 79, the bored belt motor driving circuit 41 is changed to a drum motor driving circuit 80, and the reference numeral of the heating unit is changed from 25 to 52. In addition, details of the moisture adjustment control performed in the control unit 31 are the same as that in the first embodiment.

Thus, in the ink jet printer according to the second embodiment, in addition to effects of the ink jet printer according to the first embodiment, it is possible to rotate the print medium 2 in a state in which the print medium 2 is attracted onto the outer periphery of the bored rotation drum 51 by sucking air from the inside and it is possible to effectively decrease the difference of moisture between the printing surface of the print medium 2 and the opposite surface thereof by heating the print medium 2 from the outer side of the outer periphery of the bored rotation drum 51. In addition, it is possible to turn the print medium 2 over by discharging the print medium 2 when the bored rotation drum 51 is half rotated.

Figure 13:
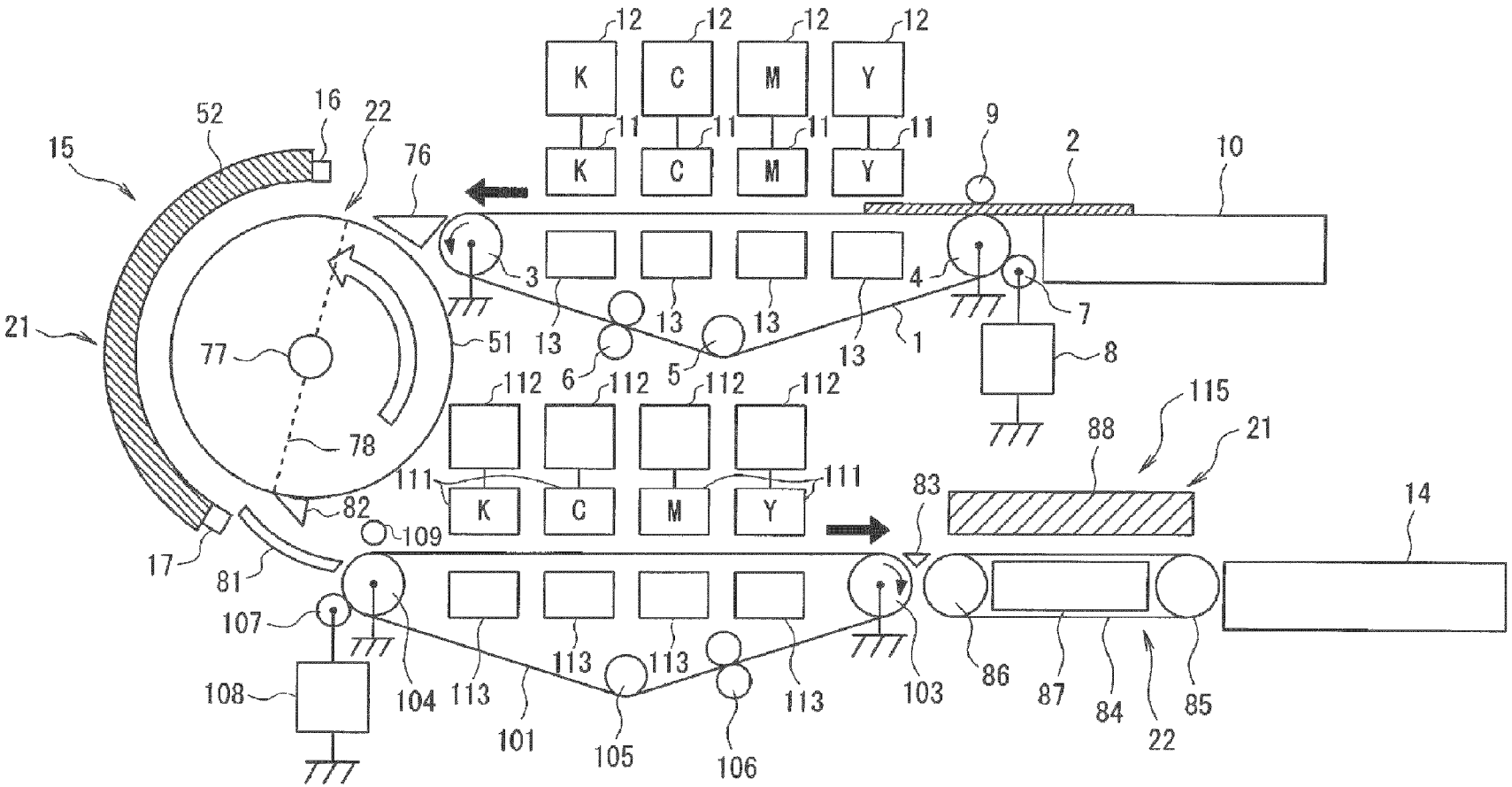
FIG. 13 is a front view schematically illustrating the configuration of an ink jet printer according to a third embodiment of the invention.

Next, a third embodiment of the invention will be described. FIG. 13 is a front view schematically illustrating the configuration of an ink jet printer according to the third embodiment. Many constituent members herein are equal to those in the ink jet printer according to the second embodiment shown in FIG. 10. Therefore, the same constituent members are denoted by the same reference numerals, and a detailed explanation thereof will be omitted.

The third embodiment is different from the second embodiment in that a second ink jet head 111 is provided at a downstream side of the moisture adjusting unit 15 in the print medium transport direction, a second moisture adjusting unit 115 is further provided at the downstream side of the second ink jet head 111 in the print medium transport direction, and the discharge portion 14 is provided at the downstream side of the second moisture adjusting unit 115 in the print medium transport direction. In the drawing, reference numeral 101 denotes a second transport belt, reference numeral 103 denotes a second driving roller, reference numeral 104 denotes a second driven roller, reference numeral 105 denotes a second tension roller, reference numeral 106 denotes a second belt cleaner, reference numeral 107 denotes a second charging roller, reference numeral 108 denotes a second high-voltage power supply, reference numeral 109 denotes a second paper pressure roller, reference numeral 111 denotes a second ink jet head, reference numeral 112 denotes a second ink cartridge, and reference numeral 113 denotes a second cleaning unit. Functions of those described above are equal to those of the transport belt 1, the driving roller 3, the driven roller 4, the tension roller 5, the belt cleaner 6, the charging roller 7, the high-voltage power supply 8, the paper pressure roller 9, the ink jet head 11, the ink cartridge 12, and the cleaning unit 13 in the first embodiment. However, in the third embodiment, the print medium 2 is transported from left to right in the drawing because the second driving roller 103 is provided at the right side in the drawing and the second driven roller 104 is provided at the left side in the drawing. In addition, a transferring member 81 is provided between the second transport belt 101 and the bored rotation drum 51 that forms the moisture adjusting unit 15, and a detaching member 82 for detaching the print medium 2 from the bored rotation drum 51 is provided around the bored rotation drum 51 positioned above the transferring member 81. Accordingly, the print medium 2 attracted on the bored rotation drum 51 that forms the moisture adjusting unit 15 is transferred onto the second transport belt 101 by means of the bored rotation drum 51 in a state in which the print medium 2 is turned over by the bored rotation drum 51. Then, the print medium 2 is transported in a state in which the print medium 2 is electrostatically attracted on the second transport belt 101 that is electrically charged by the second charged roller 107 and ink droplets are discharged from the second ink jet head 111, such that printing on the surface opposite the printing-completed printing surface, so-called printing on a bottom surface is performed.

Figure 14A:
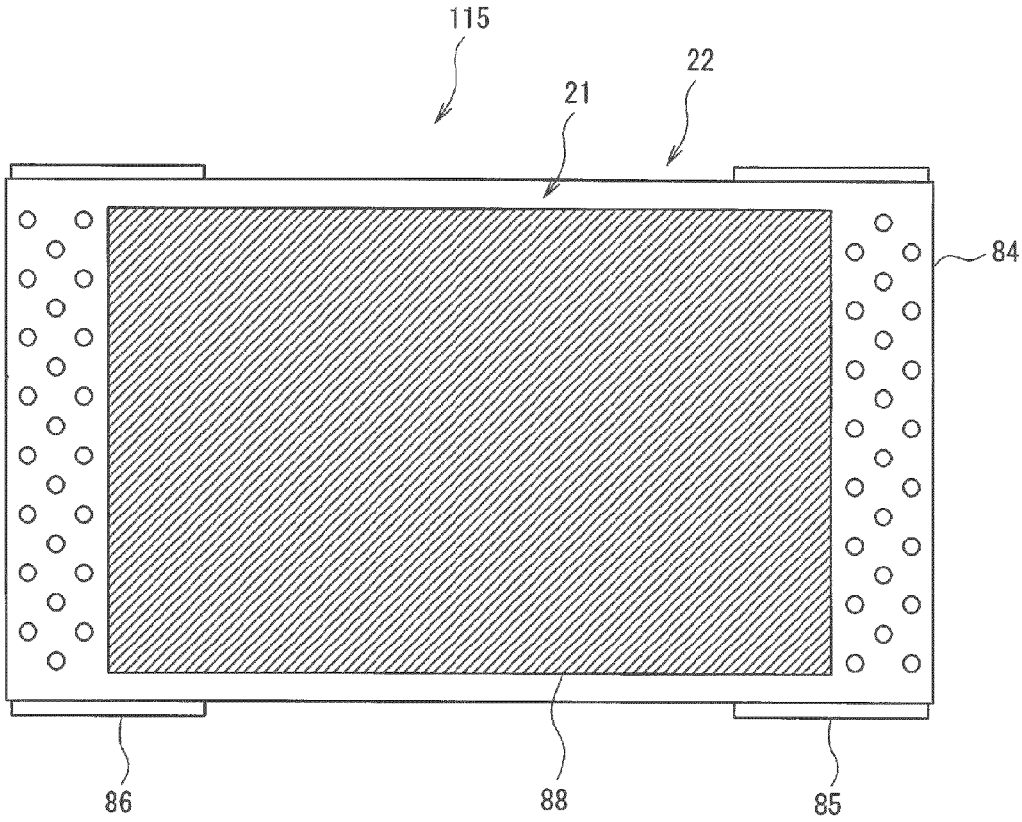
FIG. 14A is a plan view and FIG. 14B is a front view.
Figure 14B:
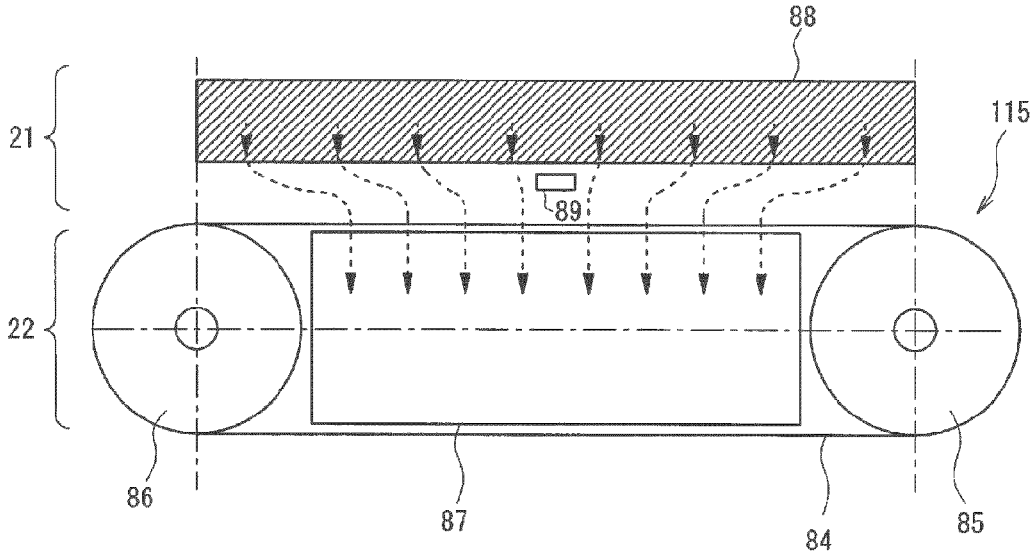

In the same manner as the moisture adjusting unit 15, the second moisture adjusting unit 115 is configured to include a heating device 21 that heats a printing surface immediately after printing, which is printed by the second ink jet head 111, and a suction device 22 that sucks air from the opposite side. Details of the moisture adjusting unit 15 are shown in FIG. 14. In the third embodiment, a second bored transport belt 84 is used for transport of the print medium 2. The second bored transport belt 84 is wound around a second bored transport belt driving roller 85 disposed at a downstream side in the print medium transport direction, that is, at the right side shown in the drawing and a second bored transport belt driven roller 86 disposed at an upstream side in the print medium transport direction, that is, at the left side shown in the drawing. The second bored transport belt driving roller 85 is connected to a second bored belt motor that is not shown. In addition, a second suction fan 87 is provided inside the second bored transport belt 84 that is driven by a second fan motor that is not shown. In addition, a second heating unit 88 is provided above the second bored transport belt 84 and a second temperature sensor 89 is provided therebelow. In addition, a transferring member 83 that helps transferring of the print medium 2 is provided between the second transport belt 101 and the second moisture adjusting unit 115.

Figure 15:
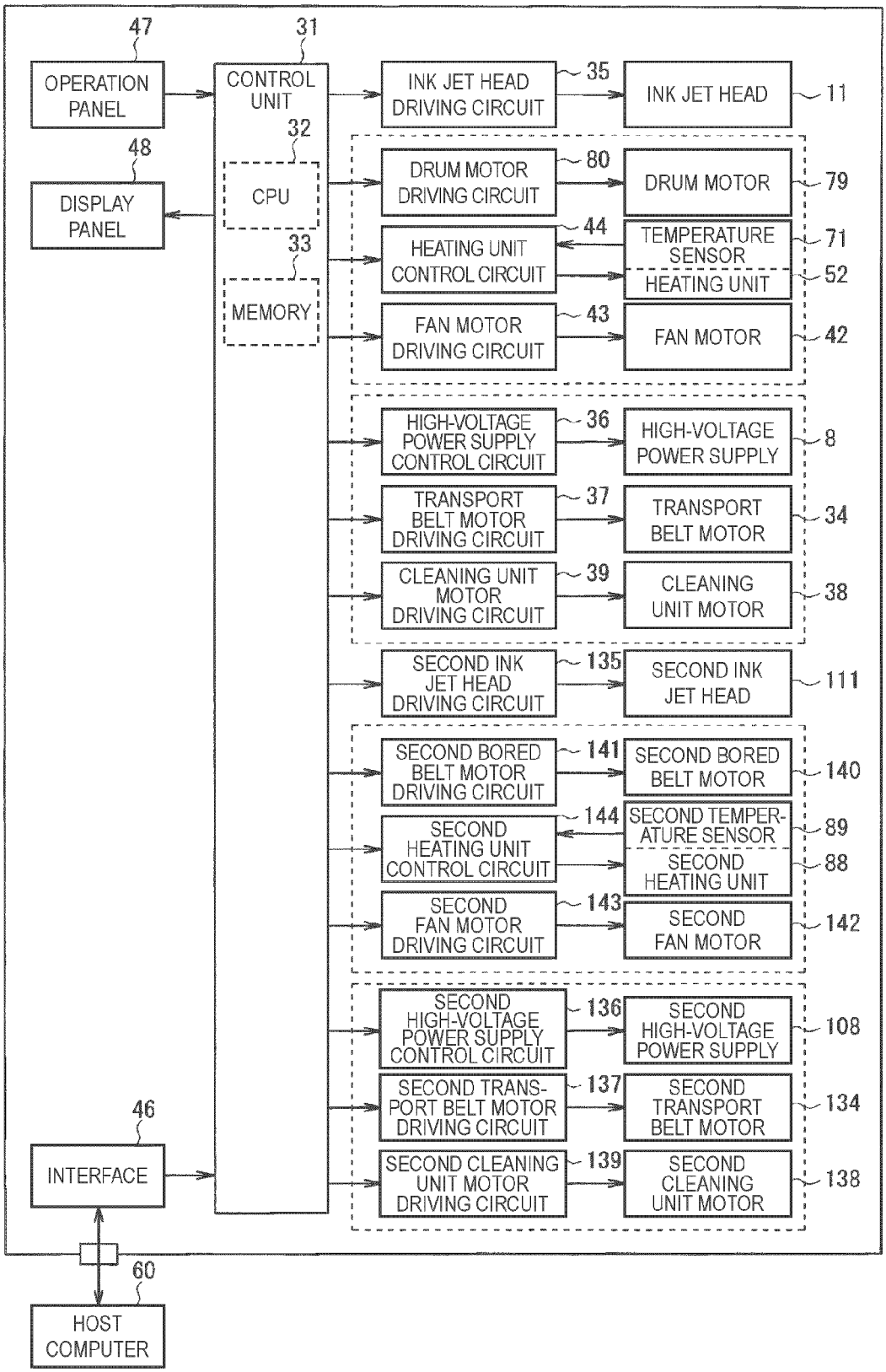
FIG. 15 is a block diagram illustrating the configuration of the ink jet printer shown in FIG. 13.

FIG. 15 illustrates the ink jet printer according to the third embodiment and the host computer 60 for driving the ink jet printer. Many functional blocks in the ink jet printer according to the third embodiment are equal to those in the ink jet printer according to the second embodiment shown in FIG. 12. Therefore, the same functional blocks are denoted by the same reference numerals, and a detailed explanation thereof will be omitted. In the third embodiment, a second ink jet head driving circuit 135 that drives the second ink jet head 111, a second high-voltage power supply control circuit 136 that controls the second high-voltage power supply 108, a second transport belt motor driving circuit 137 that drives a second transport belt motor 134 for driving the second transport belt 101, a second cleaning unit motor driving circuit 139 that drives a second cleaning unit motor 138 for driving the second cleaning unit 113, a second bored belt motor driving circuit 141 that drives a second bored belt motor 140 for driving the second bored transport belt 84, a second fan motor driving circuit 143 that drives a second fan motor 142 for driving the second suction fan 87, and a second heating unit control circuit 144 that controls the second heating unit 88 of the heating device 21 on the basis of the detection temperature of the second temperature sensor 89 are provided in addition to the ink jet printer according to the second embodiment. In addition, a print medium detecting circuit that detects paper jam from the first and second photosensors is not shown. In addition, details of the moisture adjustment control performed in the control unit 31 are the same as that in the first embodiment.

Thus, in the ink jet printer according to the third embodiment, the same effects as in the ink jet printers according to the first and second embodiments can be obtained, and at the same time, high-speed double-sided printing becomes possible.

Figure 16:
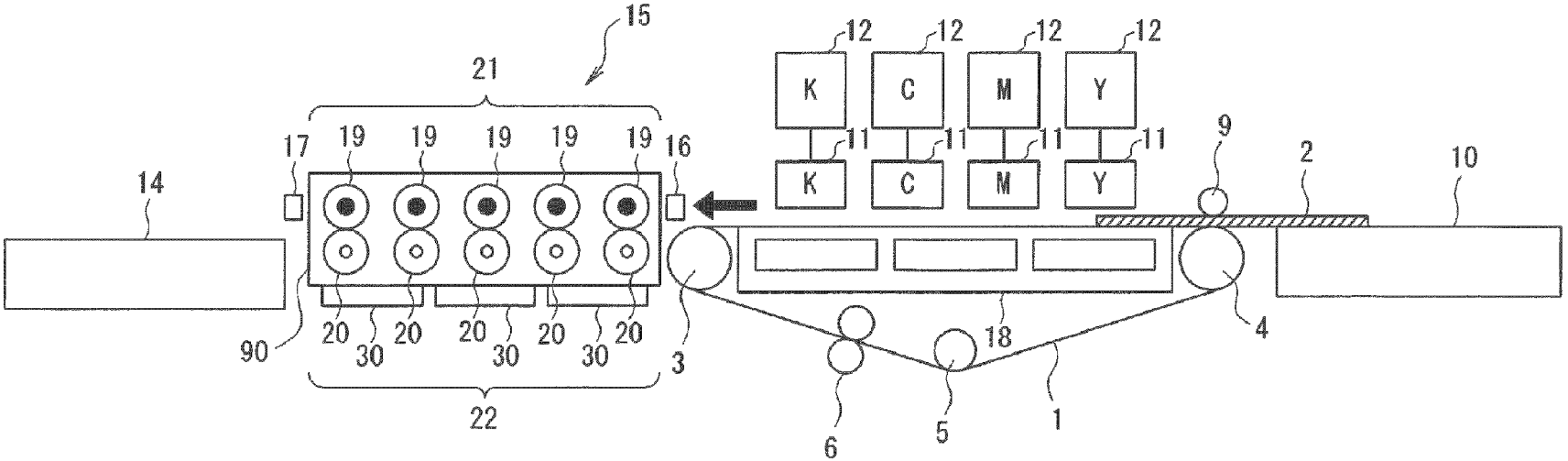
FIG. 16 is a front view schematically illustrating the configuration of an ink jet printer according to a fourth embodiment of the invention.

Next, a fourth embodiment of the invention will be described. FIG. 16 is a front view schematically illustrating the configuration of an ink jet printer according to the fourth embodiment. Many constituent members herein are equal to those in the ink jet printer according to the first embodiment shown in FIG. 1. Therefore, the same constituent members are denoted by the same reference numerals, and a detailed explanation thereof will be omitted. Moreover, in FIG. 16, illustration of a transport belt charging system that uses a charging roller, a high-voltage power supply, and the like is omitted. In addition, in the fourth embodiment, an ink receiving and the suction device 18 is provided instead of the cleaning unit according to the first embodiment. The ink receiving and the suction device 18 is not in contact with and spaced apart from the ink jet head 11 unlike the cleaning unit in the first embodiment and is positioned below an upper outer peripheral surface of the transport belt 1. The ink receiving and the suction device 18 receives ink droplets discharged from the ink jet head 11 by means of flushing from the ink jet head 11 and causes the discharged ink droplets to be sucked and discharged to a waste ink tank that is not shown.

Figure 17:
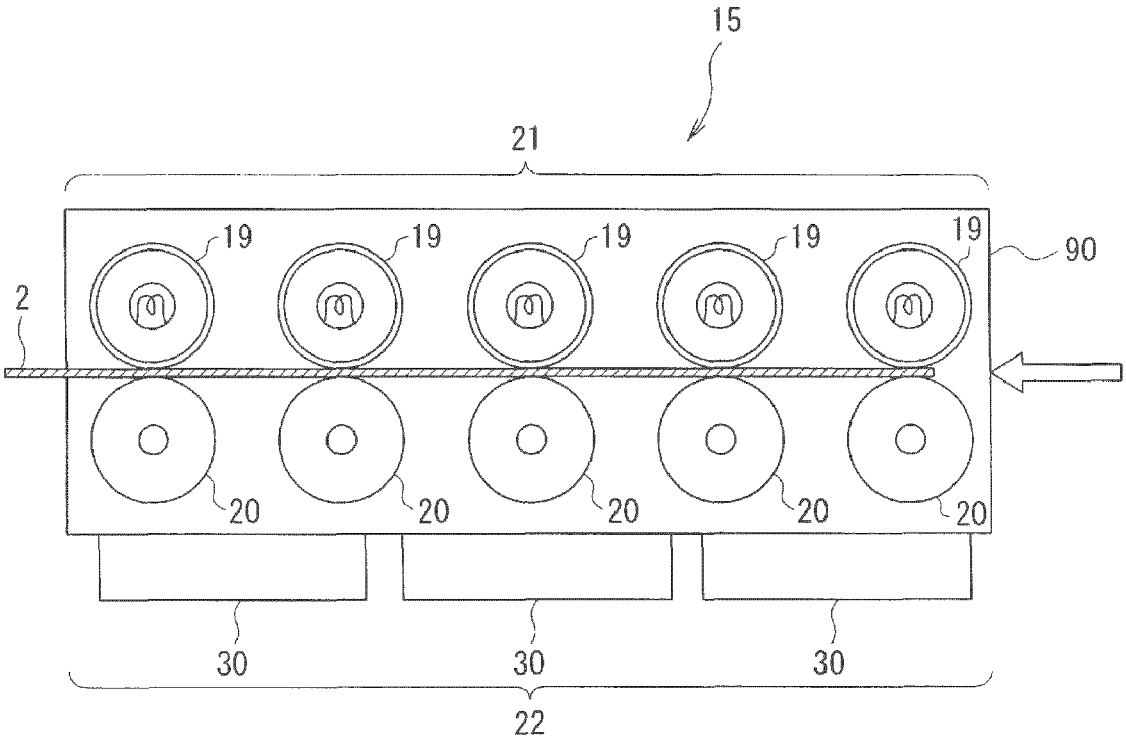
FIG. 17 is a front view illustrating the configuration of the moisture adjusting unit shown in FIG. 16.

In the fourth embodiment, the configuration of the moisture adjusting unit 15 that adjusts the moisture of the print medium 2 is changed as compared with the first embodiment. However, there is no change in that the printing surface side of the print medium 2 corresponds to the heating device 21 and the opposite side thereof corresponds to the suction device 22. Details of the moisture adjusting unit 15 are shown in FIG. 17. The suction device 22 in the fourth embodiment includes suction fans 30 provided below a housing 90 through which the print medium 2 is transmitted, and a hole through which air moves is provided on an upper surface of the housing 90. Totally five heating rollers 19 are provided at predetermined distances therebetween above the print medium transport line within the housing 90, and pressure rollers 20 are provided below the heating rollers 19 so as to be opposite to the heating rollers 19. The pressure roller 20 is pressed against the heating roller 19 with a predetermined load to thereby form a nip portion between the heating roller 19 and the pressure roller 20. A heating unit is provided inside the heating roller 19. In the fourth embodiment, the print medium 2 is transported in a state in which the print medium 2 is placed in the nip portion between the heating roller 19 and the pressure roller 20, and at the same time, a printing surface of the print medium 2 is heated by the heating roller 19.

Figure 18:
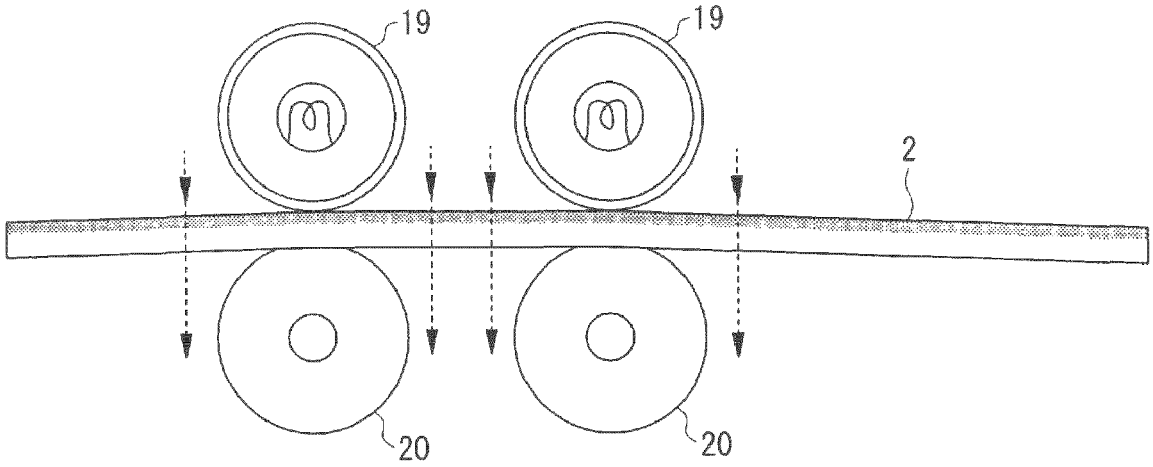
FIG. 18 is a view explaining an operation of the moisture adjusting unit shown in FIG. 17.

FIG. 18 illustrates details of a transport state of the print medium 2 using the heating roller 19 and the pressure roller 20. FIG. 18 shows a state in which ink droplets are discharged from the ink jet head 11 onto an upper surface of the print medium 2 and the upper surface is wet. As mentioned above, the moisture that is a solvent of water-based ink is vaporized after printing the print medium 2 that is in contact with the heating roller 19 that is the heating device 21. Since the air within the housing 90 is sucked by the suction fan 30 that is the suction device 22, vapor of the water-based ink generated at a printed surface side of the print medium 2 moves to a surface opposite to the printed surface through the inside of the print medium 2 and is then sucked from the surface into the suction device 22 in some cases. As a result, since a difference of moisture between the printing surface of the print medium 2 and the opposite surface thereof decreases, occurrence of the permanent curl is prevented.

The control unit in the fourth embodiment is almost the same as that in the first embodiment, and accordingly, a control made by the control unit in the fourth embodiment is almost the same as that in the first embodiment. Thus, in the ink jet printer according to the fourth embodiment, in addition to the effects of the ink jet printer according to the first embodiment, it is possible to more effectively decrease the difference of moisture between the printing surface of the print medium 2 and the opposite surface thereof with the help of vaporization of ink because the print medium 2 is transported in a state in which the print medium 2 is interposed between the heating roller 19, which rotates in contact with the printing surface of the print medium 2 onto which ink droplets from the ink jet head 11 are discharged, and the pressure roller 20 provided opposite the heating roller 19.

Figure 19:
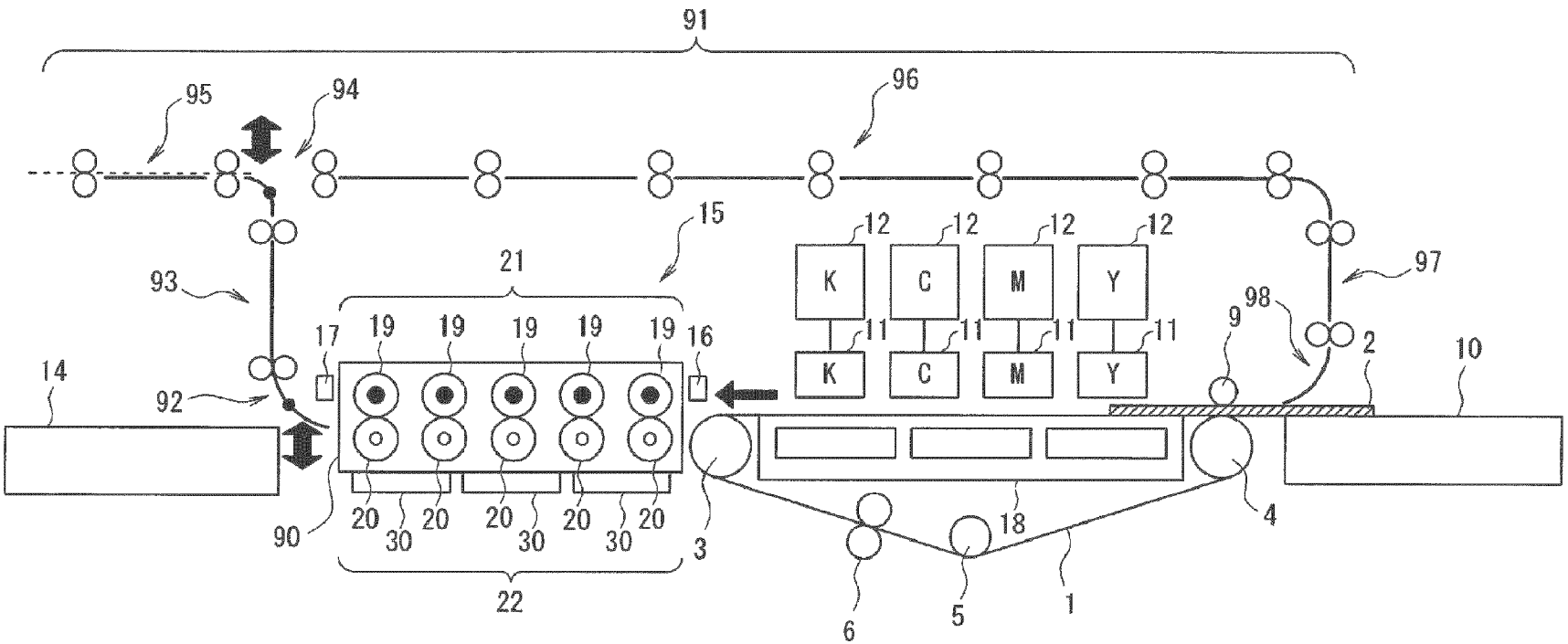
FIG. 19 is a front view schematically illustrating the configuration of an ink jet printer according to a fifth embodiment of the invention.

Next, a fifth embodiment of the invention will be described. FIG. 19 is a front view schematically illustrating the configuration of an ink jet printer according to the fifth embodiment. Many constituent members herein are equal to those in the ink jet printer according to the fourth embodiment shown in FIG. 16. Therefore, the same constituent members are denoted by the same reference numerals, and a detailed explanation thereof will be omitted. Moreover, in FIG. 16, illustration of a transport belt charging system that uses a charging roller, a high-voltage power supply, and the like is omitted.

In the fifth embodiment, a reversing device 91 that reverses the print medium 2 is provided above the ink jet head 11 so as to make double-sided printing possible, as compared with the ink jet printer according to the fourth embodiment. The reversing device 91 includes: a drawing portion 92 that draws the print medium 2, in which printing on only one surface has been completed, at the upstream side of the discharge portion 14 in the print medium transport direction; a raising portion 93 that raises the print medium 2, which is drawn by the drawing portion 92, up to the reversing device 91; a reversing portion 95 that reverses the print medium 2 raised by the raising portion 93; a returning portion 96 that returns the print medium 2, which is reversed by the reversing portion 95, to the paper feed unit 10; a lowering portion 97 that lowers the print medium 2 returned by the returning portion 96; and a sending portion 98 that sends the print medium 2 lowered by the lowering portion 97 again onto the transport belt 1. Between the raising portion 93 and the reversing portion 95 and the returning portion 96, a selection portion 94 that selects the sending direction of the print medium 2 is interposed.

The control unit in the fifth embodiment is almost the same as that in the fourth embodiment, and accordingly, a control made by the control unit in the fifth embodiment is almost the same as that in the fourth embodiment. Accordingly, in the ink jet printer according to the fifth embodiment, the double-sided printing can be performed relatively simply in addition to the effects in the fourth embodiment.

In addition, even though only examples in which the ink jet printer of the invention is applied to the line head type ink jet printers have been described in detail in the first to fifth embodiments, the ink jet printer of the invention may be applied to all kinds of ink jet printers, which use water-based ink, including a multi-pass type printer.

What is claimed is:

1. An ink jet printer that performs printing by discharging ink droplets from nozzles of an ink jet head onto a print medium, comprising:

a moisture adjusting unit that is provided at a downstream side of the ink jet head in a print medium transport direction and adjusts moisture of the print medium by moving moisture of a printing surface of the print medium, onto which the ink droplets are discharged from the ink jet head, to a surface opposite the printing surface, the moisture adjusting unit including:

a heating portion that heats the printing surface of the print medium, onto which the ink droplets are discharged from the ink jet head; and a suction portion that generates a flow of air in the direction from the printing surface of the print medium to the surface opposite the printing surface;

a moisture adjustment control unit that controls moisture adjustment of the print medium performed by the moisture adjusting unit in accordance with a ratio of the number of nozzles, from which the ink droplets from the ink jet head are discharged, to the total number of nozzles; and a pair of bored transport belts that transport the print medium in a state in which the print medium is pinched between the heating portion and the suction portion, wherein holes of the pair of bored transport belts are shifted from each other.

2. The ink jet printer according to claim 1, wherein the moisture adjusting unit reduces a difference of moisture between the printing surface of the print medium, onto which the ink droplets are discharged from the ink jet head, and the surface opposite the printing surface.

3. The ink jet printer according to claim 1, wherein the heating portion supplies heated air onto the printing surface of the print medium.

4. The ink jet printer according to claim 1, wherein the suction portion is a bored rotation drum rotating in a state in which the print medium is attracted on an outer periphery thereof by sucking air from the inside, and the heating portion is provided at an outer side of the outer periphery of the bored rotation drum.

5. The ink jet printer according to claim 1, wherein the heating portion is configured to include a heating roller that rotates in contact with the printing surface of the print medium, onto which the ink droplets are discharged from the ink jet head, and the print medium is transported in a state in which the print medium is pinched between the heating roller and a pressure roller provided opposite the heating roller.

6. The ink jet printer according to claim 1, wherein the moisture adjustment control unit causes the moisture adjusting unit to perform moisture adjustment of the print medium when the ratio of the number of nozzles, from which the ink droplets are discharged, to the total number of nozzles is a predetermined ratio or more.

* * * * *